United States Patent [19]

Kiwaki et al.

[11] 4,012,019

[45] Mar. 15, 1977

[54] CAR SIGNALING SYSTEM

[75] Inventors: Hisakatsu Kiwaki; Hiroshi Okubo, both of Katsuta, Japan

[73] Assignee: Hitachi, Ltd., Japan

[22] Filed: Aug. 19, 1975

[21] Appl. No.: 605,832

[30] Foreign Application Priority Data

Aug. 26, 1974 Japan ..... 49-97100

[52] U.S. Cl. ..... 246/34 R

[51] Int. Cl.[2] ..... B61L 21/06

[58] Field of Search ..... 246/30, 40, 167 D, 182 B, 246/187 B, 187 C, 122 R, 34 R, 34 CT; 340/32, 33; 180/98; 191/2

[56] References Cited

UNITED STATES PATENTS

| | | | |
|---|---|---|---|
| 3,078,944 | 2/1963 | Gray | 180/98 |
| 3,817,344 | 6/1974 | Asano | 246/167 D |

FOREIGN PATENTS OR APPLICATIONS

| | | | |
|---|---|---|---|
| 1,291,765 | 4/1969 | Germany | 246/167 D |

*Primary Examiner*—Trygve M. Blix
*Assistant Examiner*—Reinhard J. Eisenzopf
*Attorney, Agent, or Firm*—Craig & Antonelli

[57] ABSTRACT

A signaling system for cars having wheels adapted for running along a track, in which a signal wire is disposed to extend along the track, a pantograph is provided on each car to make sliding engagement with the signal wire, and a detector apparatus responsive to the sliding movement of the pantograph along the signal wire is provided to detect the relative interval between the cars.

18 Claims, 17 Drawing Figures

| RECEIVED SIGNAL | SIGNAL INDICATION | TRANSMITTED SIGNAL |
|---|---|---|
| NONE | RED RED | $f_{RR}$ |
| $f_{RR}$ | RED | $f_R$ |
| $f_R$ | YELLOW | $f_Y$ |
| $f_Y$ | GREEN | $f_G$ |
| $f_G$ | GREEN | $f_G$ |

CAR SIGNALING SYSTEM

BACKGROUND OF THE INVENTION

This invention relates to car signaling systems, and more particularly to a signaling system of the kind above described in which means are provided for detecting accurately the interval between successive cars.

In traffic facilities such as railways in which trains run along trackage, each train is required to run at an allowable speed determined by the conditions of rails while maintaining a safe interval between it and the preceding train. This interval is desirably as small as possible so that more trains can run along the same track. It is therefore necessary for each train to detect the distance between it and the preceding train, and if possible, those factors such as the speed and deceleration of the preceding train, and to control the running speed thereof depending on the running condition of the preceding train, so that it can run while maintaining an allowable minimum interval between it and the preceding train.

A car signaling system has been commonly employed to meet the above requirement, in which the track is divided into a plurality of block sections, and a suitable detecting device is provided in each of these block sections for detecting the presence or absence of a car in the specific block section. In the known car signaling system, the detecting device in each block section detects the presence of a car in the block section when the two rails in the block section are short-circuited by the rail-engaging wheels of the car, and the result of detection is transmitted to means provided for detecting the interval between this car and the preceding car running along the same track.

However, this known car signaling system is solely applicable to the case in which both the rails and the rail-engaging wheels of cars are of electrically conductive material. Thus, this known car signaling system is defective in that it is not applicable to cars adapted for running with rail-engaging wheels of, for example, rubber. Further, in order to detect the interval between the cars with high precision, the track must be divided into many block sections of considerably short length resulting in the increase in the number of block sections. Thus, the known car signaling system is defective in that the number of detecting means for detecting the presence of the cars in the block sections is increased resulting in high equipment costs.

SUMMARY OF THE INVENTION

It is an object of the present invention to provide a car signaling system which is applicable to cars of all the types regardless of the material of the rail-engaging wheels.

Another object of the present invention is to provide an inexpensive car signaling system which is applicable to cars of all the types.

In accordance with one aspect of the present invention, there is provided a signaling system for cars adapted for running along a track, comprising a signal wire disposed to extend along said track, pantograph means mounted on each of said cars for making sliding engagement with said signal wire, and means responsive to the sliding movement of said pantograph means along said signal wire for detecting the relative interval between said cars.

In accordance with another aspect of the present invention, there is provided a car signaling system of the above character, wherein said signal wire is divided into a plurality of block sections, adjacent ones of said block sections being connected with each other by an impedance element, and said detecting means is mounted in each of said cars to detect the relative interval between said cars by measuring the impedance of the signal wire portion between said cars.

Other objects, features and advantages of the present invention will become apparent from the following detailed description taken in conjunction with the accompanying drawing.

DESCRIPTION OF THE PREFERRED EMBODIMENTS

Figure 1:
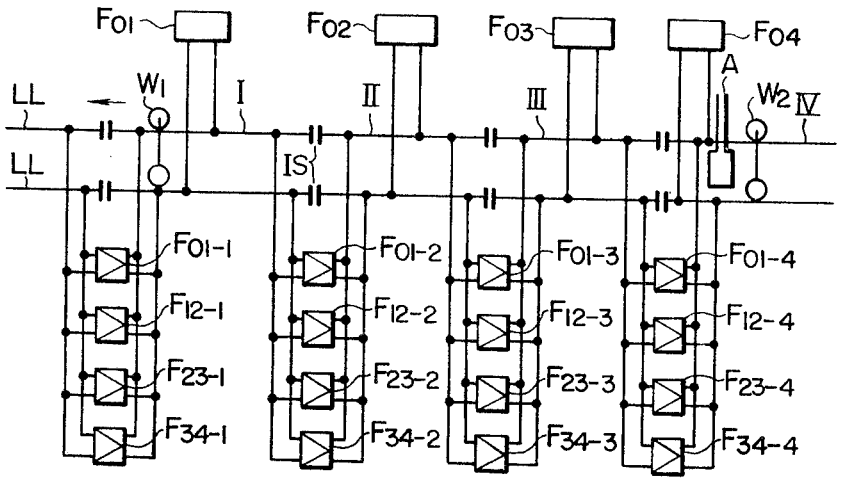
FIG. 1 PRIOR ART
FIG. 1 is a circuit diagram of known car signaling system.

FIG. 1 is a circuit diagram of a known car signaling system. Referring to FIG. 1, a pair of rails LL are divided into a plurality of block sections I, II, III and IV by electrical insulating portions IS. A plurality of oscillators $F_{01}$ to $F_{04}$ are connected to the rails LL for applying to the respective block sections I to IV an allowable speed signal corresponding to the conditions of the rails LL in each of the block sections I to IV. A plurality of frequency converting amplifiers $F_{01\text{-}l}$ to $F_{34\text{-}4}$ are also connected to the rails LL. For example, the amplifiers $F_{01\text{-}l}$ to $F_{01\text{-}4}$ generate an output signal of frequency $f_1$ only when the frequency component of the input is nil. The amplifiers $F_{12\text{-}1}$ to $F_{12\text{-}4}$ generate an output signal of frequency $f_2$ only when the input is a signal component of frequency $f_1$. Similarly, the amplifiers $F_{23\text{-}1}$ to $F_{23\text{-}4}$ generate an output signal of frequency $f_3$ only when the input is a signal component of frequency $f_2$, and the amplifiers $F_{34\text{-}1}$ to $F_{34\text{-}4}$ generate an output signal of frequency $f_4$ only when the input is a signal component of frequency $f_3$. In FIG. 1, two trains are running in a direction as shown by the arrow, and the rail-engaging wheels of the preceding and succeeding trains are designated by $W_1$ and $W_2$ respectively.

In the prior art car signaling system shown in FIG. 1, the output signal of the oscillator $F_{04}$ in the block section IV is received by an antenna A mounted on the succeeding train, and the allowable speed in this portion of the rails LL is detected. On the other hand, the rail-engaging wheels $W_1$ of the preceding train short the signal transmitted from forward portion of the wheels $W_1$ through the rails LL, and no signal is transmitted to the portion of the rails LL rearward of the rail-engaging wheels $W_1$. Thus, the amplifier $F_{01-2}$ sends out the signal of frequency $f_1$ to the rails LL in the block section II, and the amplifier $F_{12-3}$ sends out the signal of frequency $f_2$ to the rails LL in the block section III. The amplifier $F_{23-4}$ sends out the signal of frequency $f_3$ to the rails LL in the block section IV. This signal is shorted by the rail-engaging wheels $W_2$ of the succeeding train, and the signal current of frequency $f_3$ flows through the closed circuit consisting of the rails LL, rail-engaging wheels $W_2$ and amplifier $F_{23-4}$. The antenna A receives this signal current to detect that the succeeding train is spaced apart from the preceding train by a distance corresponding to two block sections. The antenna A receives also from the oscillator $F_{04}$ the allowable speed signal corresponding to the conditions of the rails LL in the block section IV. In the block sections following the block section IV, the interval between successive trains can also be similarly detected.

While this car signaling system is technically realizable, its application is limited to the transportation facilities in which both the rail-engaging wheels of cars and the rails are of electrical conductive material. Thus, this prior art system is defective in that it is not applicable to transportation facilities in which cars are provided with rail-engaging wheels of, for example, rubber. Further, this prior art system is complex in structure and arrangement, the reliability thereof is relatively low and the equipment cost is quite high due to the fact that the oscillators $F_{01}$ and $F_{04}$ and the amplifier groups $F_{01-1}$ to $F_{34-1}$ through $F_{01-4}$ to $F_{34-4}$ must be provided in the respective block sections I to IV. It is required to decrease the interval between trains in order that more trains can run along the same track as described previously. In order to meet this requirement, the precision of interval detection must be improved, and therefore, the length of the block sections must be shortened to increase the number of the block sections. Thus, the prior art car signaling system shown in FIG. 1 is not completely satisfactory to be put into practical use due to the complex structure and arrangement thereof and from the economical point of view.

In the railway portions where the conditions of the rails are such that trains can run at a high speed, the length of the individual block sections in FIG. 1 may be increased to decrease the number of the oscillators $F_{01}$ to $F_{04}$ and the number of the amplifier groups $F_{01-1}$ to $F_{34-4}$. However, due to the fact that the prior art car signaling system shown in FIG. 1 is only capable of detecting the number of block sections between the preceding and succeeding trains, division of the rails into block sections of different lengths necessitates provision of separate means for detecting also the information of the lengths of the individual block sections, resulting rather in more complication of the structure and arrangement of the system.

Figure 2:
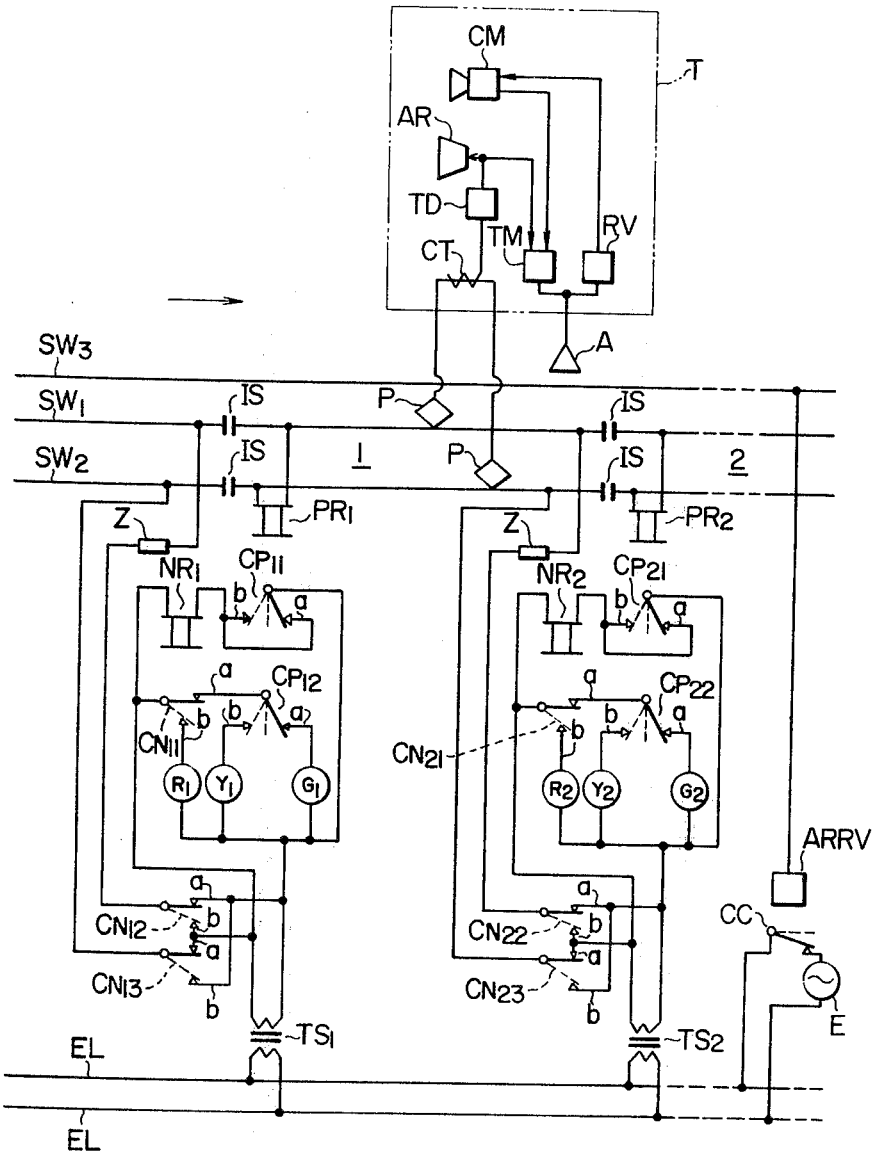
FIG. 2 is a circuit diagram of an embodiment of the car signaling system according to the present invention.

The defect of the prior art car signaling system, which is only applicable to the transportation facilities using rails and rail-engaging wheels of electrical conductive material, is obviated by the present invention which is applicable to cars of all the types regardless of the material of the rail-engaging wheels. FIG. 2 is a circuit diagram of an embodiment of the car signaling system according to the present invention.

A car signaling system applicable to cars of all the types regardless of the material of the rail-engaging wheels is presently demanded since the use of rubber as the material of the rail-engaging wheels is presently considered for the following reasons among others:

1. Rail-engaging wheels of rubber are preferable for urban traffic facilities to those of iron since the former produce less noise than the latter.
2. Rail-engaging wheels of rubber have a higher coefficient of adhesion than that of rail-engaging wheels of iron and are thus more suitable than the latter for various applications including an application to tracks including many ups and downs.
3. Rail-engaging wheels of rubber provide a better sense of ride than rail-engaging wheels of iron since the rubber wheels themselves have a shock absorbing function.

Referring now to FIG. 2, a pair of signal wires $SW_1$ and $SW_2$ are disposed to extend along a track and are electrically insulated from the ground, and a car T is adapted for running along the track with rail-engaging wheels of rubber. The signal wires $SW_1$ and $SW_2$ are electrically divided into a plurality of block sections 1 and 2 by electrical insulating means IS. Another signal wire $SW_3$ for communication purposes is also disposed along the same track. A pair of pantographs P are mounted on the car T for making sliding engagement with the respective signal wires $SW_1$ and $SW_2$ to short them. An antenna A is provided on the car T opposite to the signal wire $SW_3$. A current transformer CT is provided in the car T for detecting dis-appearance of the short-circuit current flowing through the pantographs P. A timer TD is provided in the car T to operate in response to the disappearance of the output from the current transformer CT. An alarm means AR is provided in the railway car T to generate an alarm signal in response to the operation of the timer TD. A transmitter TM and a receiver RV are connected to a communication equipment CM provided in the car T for the purpose of communication with similar communication equipments provided on the ground and in other cars. An alarm receiver ARRV having a normally-closed contact CC is provided on the ground. An A.C. power source E supplies A.C. power to distribution lines EL.

Polar relays $PR_1$ and $PR_2$ having relay contacts $CP_{11}$, $CP_{12}$ and $CP_{21}$, $CP_{22}$ respectively are connected across the signal wires $SW_1$ and $SW_2$. The relay contacts of these polar relays $PR_1$ and $PR_2$ are closed at the contact position *a* when the phase of a signal voltage (an A.C. voltage) applied through the signal wires $SW_1$ and $SW_2$ is the same as that of the A.C. voltage of the distribution lines EL. (This signal voltage is called hereinafter a positive voltage.) On the other hand, the relay contacts of the polar relays $PR_1$ and $PR_2$ are closed at the contact position *b* when the phase of the signal voltage is opposite to that of the A.C. voltage of the distribution lines EL. (This latter signal voltage is called hereinafter a negative voltage.) Neutral relays $NR_1$ and $NR_2$ having relay contacts $CN_{11}$, $CN_{12}$, $CN_{13}$ and $CN_{21}$, $CN_{22}$, $CN_{23}$ respectively are closed at the contact position *a* when energized and at the contact position *b* when deenergized. The car signaling system further includes transformers $TS_1$, $TS_{21}$, stop signal lamps $R_1$, $R_2$, caution signal lamps $Y_1$, $Y_2$, proceed signal lamps $G_1$, $G_2$, and current limiting impedance elements Z. The car T is running in a direction as shown by the arrow.

In FIG. 2, the A.C. voltage of the distribution lines EL is applied to one end (the forward end in the advancing direction of the car T) of the block sections 1 and 2 of the signal wires $SW_1$ and $SW_2$ divided by the electrical insulating means IS. For example, the A.C. voltage of the distribution lines EL is reduced by the transformer $TS_2$ to be applied to said one end of the block section 1 through the contacts $CN_{22}$ and $CN_{23}$ of the neutral relay $NR_2$ and through the current limiting impedance element Z.

Suppose now that the car T is running in the block section on the left-hand side of the block section 1 in FIG. 2 and another car is not running in the block section 2. In this case, the contact $CP_{21}$ of the polar relay $PR_2$ is closed at the contact position *a* or *b*. The neutral relay $NR_2$ is energized and the relay contacts $CN_{22}$ and $CN_{23}$ thereof are closed at the contact position *a*. As a result, the polar relay $PR_1$ is energized by the positive voltage, and the relay contacts $CP_{11}$ and $CP_{12}$ thereof are closed at the contact position *a*. The neutral relay $NR_1$ is energized by the voltage of the secondary winding of the transformer $TS_1$, and the relay contacts $CN_{11}$ to $CN_{13}$ thereof are closed at the contact position *a*. Therefore, the proceed signal lamp $G_1$ is energized by the current applied through the contacts $CN_{11}$ and $CP_{12}$ of the respective relays $NR_1$ and $PR_1$ to indicate that the car T present in the block section on the left-hand side of the block section 1 can proceed into the block section 1. That is, the lamp $G_1$ indicates that the block section 1 is cleared.

Then, when the car T proceeds into the block section 1, the signal wires $SW_1$ and $SW_2$ are shorted by the pantographs P of the car T. The polar relay $PR_1$ is deenergized and the relay contacts $CP_{11}$ and $CP_{12}$ thereof are opened. As a result, the neutral relay $NR_1$ is deenergized and the relay contact $CN_{11}$ thereof is closed at the contact position *b*. Therefore, the stop signal lamp $R_1$is energized to give a stop signal indication for the block section on the left-hand side of the block section 1, that is, it indicates that the block section 1 is occupied by the car T. Since, in this case, the relay contacts $CN_{12}$ and $CN_{13}$ of the neutral relay $NR_1$ are closed at the contact position *b*, the negative voltage is applied across the portions of the signal wires $SW_1$ and $SW_2$ in the block section on the left-hand side of the block section 1.

Then, when the running car T proceeds into the block section 2 from the block section 1, the polar relay $PR_2$ is deenergized and the relay contacts $CP_{21}$ and $CP_{22}$ thereof are opened. The neutral relay $NR_2$ is deenergized and the relay contacts $CN_{21}$ to $CN_{23}$ thereof are closed at the contact position *b*. As a result, the stop signal lamp $R_2$ is energized to give a stop signal indication for the block section 1. Further, due to the closing of the relay contacts $CN_{22}$ and $CN_{23}$ of the neutral relay $NR_2$ at the contact position *b*, the negative voltage is applied across the portions of the signal wires $SW_1$ and $SW_2$ in the block section 1. The polar relay $PR_1$ is energized by the negative voltage and the relay contacts $CP_{11}$ and $CP_{12}$ thereof are closed at the contact position *b*. As a result of the closing of the relay contact $CP_{11}$ at the contact position *b*, the neutral relay $NR_1$ is energized and the relay contacts $CN_{11}$ to $CN_{13}$ thereof are closed at the contact position *a*. Therefore, the caution signal lamp $Y_1$ is energized to give a caution signal indication for the block section on the left-hand side of the block section 1. Further, due to the closing of the relay contacts $CN_{12}$ and $CN_{13}$ of the neutral relay $NR_1$ at the contact position *a*, the positive voltage is applied across the portions of the signal wires $SW_1$ and $SW_2$ in the block section on the left-hand side of the block section 1.

Signal indications are given in a manner as above described so as to maintain a proper distance between the cars thereby securing the safety. In the car signaling system shown in FIG. 2, the signal lamps giving the signal indications are, as it were, means for roughly indicating as to whether the cars are sufficiently spaced apart from each other.

In the prior art car signaling system shown in FIG. 1, the signal circuit includes car guide rails LL laid on the ground. Therefore, leakage current or stray current tends to flow between the rails LL through the ground, and difficulty is encountered in exactly detecting the presence of the cars when such current is excessively large compared with the current due to short-circuit of the rails LL by the rail-energizing wheels W. In contradistinction, the signal wires $SW_1$ and $SW_2$ used in the embodiment of the present invention shown in FIG. 2 may have a conductivity just enough to conduct the signal current and are electrically insulated from each other by being supported by means such as porcelain insulators. Therefore, the car signaling system shown in FIG. 2 is free from any adverse effect due to leakage current or stray current and can operate with remarkably improved reliability.

In FIG. 2, the signal wires $SW_1$ and $SW_2$ are shorted by the pantographs P. These pantographs P are provided to serve the exclusive purpose of signaling, and the primary function thereof differs from that of the rail-engaging wheels of iron which are provided necessarily in a plural number for guiding the running movement of the railway cars on the rails. It is therefore difficult and undesirable to provide a number of pantographs of the kind shown in FIG. 2 on practical cars from the spatial and economical points of view. Further, the lateral displacement or rolling movement of the cars adapted for running with rubber wheels is greater than that of the railway cars adapted for running with iron wheels. Therefore, the probability of disengagement of the pantographs P from the signal wires $SW_1$ and $SW_2$ is high compared with the case in which the rail-engaging wheels W of iron are used to short the rails LL.

In order to deal with this possibility, the current transformer CT is provided in the embodiment shown in FIG. 2 for detecting the short-circuit current flowing through the pantographs P. The output of the current transformer CT disappears when at least one of the pantographs P is disengaged from the signal wire $SW_1$ or $SW_2$. When such a state lasts over a predetermined period of time of, for example, 1 second, the timer TD is actuated, and the alarm means AR generates an alarm signal so that the operator can take an emergency measure such as actuation of the emergency brakes.

Further, in response to the operation of the timer TD, the transmitter TM transmits a signal through the antenna A to the signal wire $SW_3$. This signal is also received by the antenna A, receiver RV and communication equipment CM in each of other cars. The operators of the cars running along the same track are informed of the pantograph disengagement of the specific car from the signal wires $SW_1$ and $SW_2$ and take necessary measures depending on the running conditions of the respective cars. Further, this transmitted signal is also received by the alarm receiver ARRV on the ground. Upon reception of this transmitted signal, the normally-closed contact CC of the alarm receiver ARRV is opened to disconnect the A.C. power source E from the distribution lines EL. As a result, the overall range of the track is placed in a state in which all the signal indications are completely absent, and the output of the current transformer CT in each of the cars disappears. The alarm signal is immediately generated by the alarm means AR in each car. This alarm signal is also generated even when the communication equipment CM in anyone of the cars becomes faulty so that the safety of the specific car can be secured.

In the foregoing description, the value of 1 second is selected as the period of time in which the alarm signal appears after the occurrence of disengagement of the pantographs from the signal wires. This is because the pantographs tend to be disengaged from the signal wires for a period of time of about 0.2 second even in the normal running condition of the cars. By setting this period of time at 1 second, the alarm signal can be prevented from being erroneously generated, and the danger due to excessively delayed generation of the alarm signal can also be reliably avoided.

The communication system including the signal wire $SW_3$, antenna A, transmitter TM, receiver RV and communication equipment CM is similar to that commonly provided in conventional railway cars for the purpose of communication between the railway cars themselves as well as between the railway cars and the ground station.

In the car signaling system shown in FIG. 2, the signal current from the forward block section is supplied to the current transformer CT. Therefore, the magnitude of this signal current may be varied depending on the stop signal, caution signal and proceed signal, and the signal current of varying magnitude may be detected on the car to distinguish one of these signals from the others, so that a so-called cab signalling system may be provided. Such a signaling system is suitable for application to a monorail type transportation system in which signal units are difficult to install along the track in view of the track structure, and even if installed, they may not be easily distinguished from various other lights including neon signs in urban areas. Further, the signals detected and distinguished from each other in a manner as above described may be utilized for the automatic control of the speed of the cars so as to provide a so-called automatic train control system.

It will be apparent from the above description of an embodiment of the present invention that a unique car signaling system is provided in which a pair of signal wires are disposed to extend along a track for cars, and pantographs are mounted on the cars to make sliding and shorting engagement with the signal wires so that various signal indications can be provided. Thus, the car signaling system is applicable to cars of all the types regardless of the material of the rail-engaging wheels. Further, the reliability of car operation can be improved due to the fact that disengagement of the pantographs from the signal wires can be easily detected.

The above description has referred to a car signaling system which gives signal indications for the block section lying rearward in the advancing direction of a car depending on the phase of the signal voltage. However, it is to be understood that a signal whose frequency varies depending on the physical position of the car may be applied to the signal wires to give a signal indication corresponding to the specific frequency signal.

Figure 3:
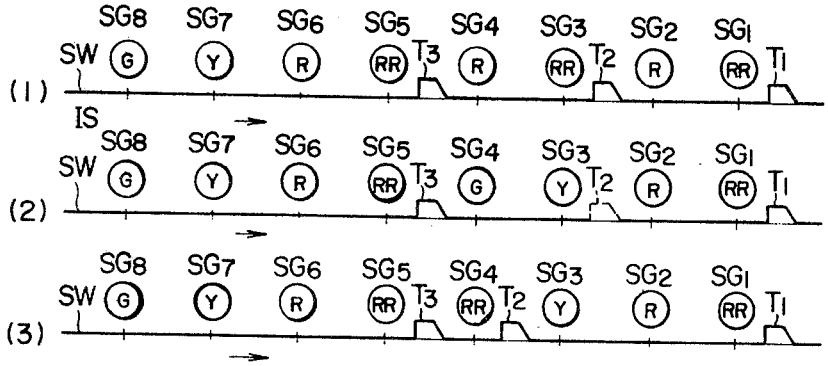
FIGS. 3 and 4 show the basic idea of another embodiment of the present invention.
Figures 4, 5:
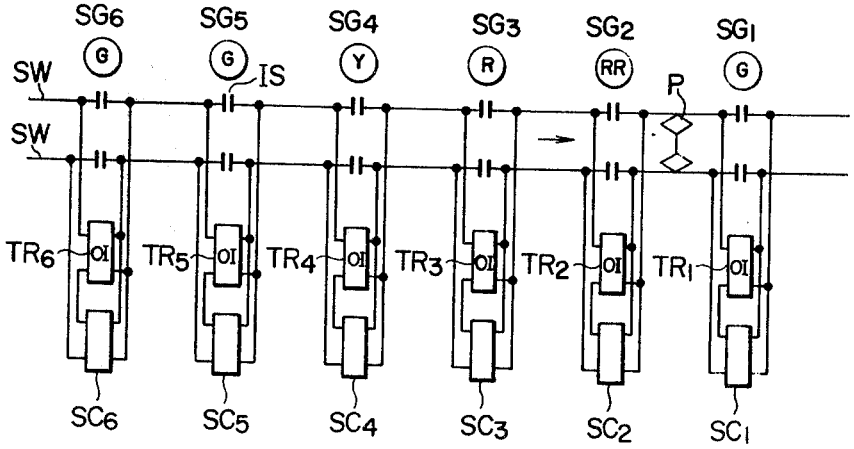
FIGS. 5 and 6 are circuit diagrams of the embodiment of the present invention based on the idea illustrated in FIGS. 3 and 4.
Figure 6:
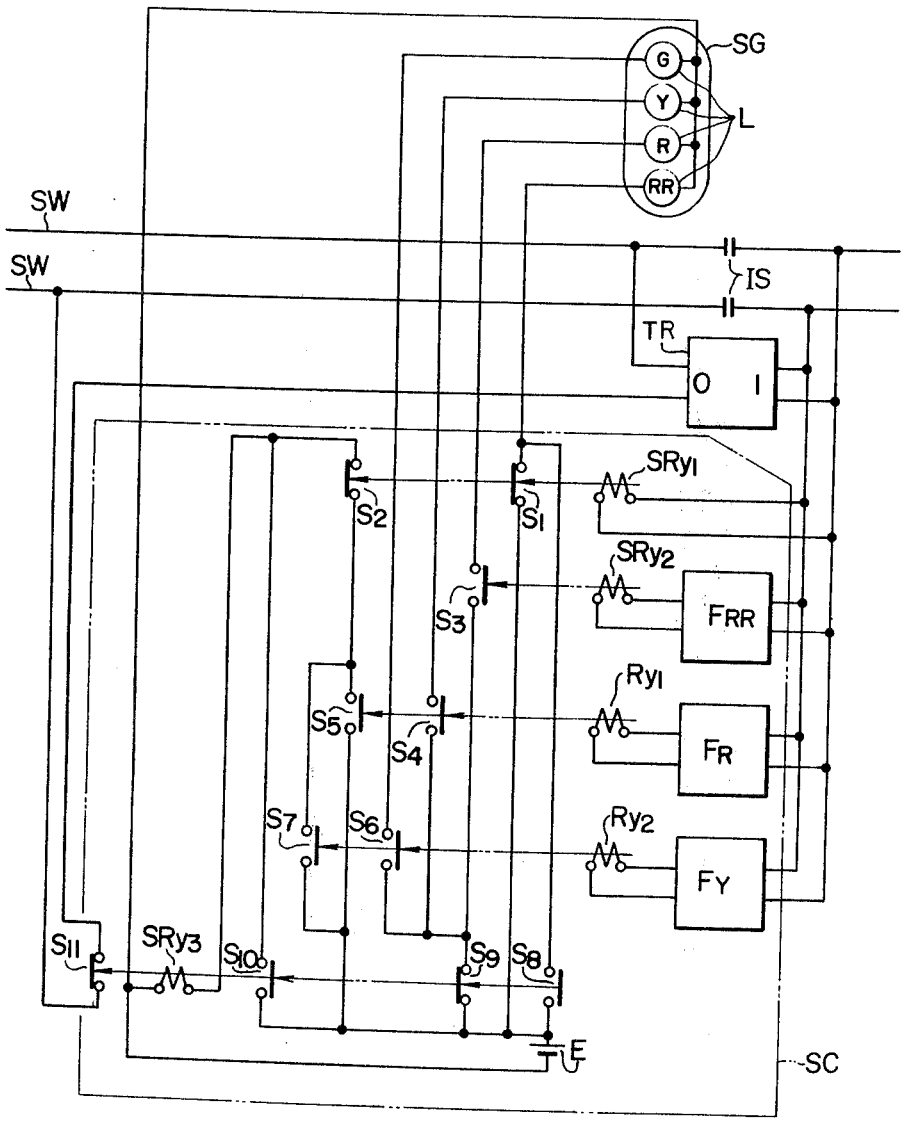
Figure 7:
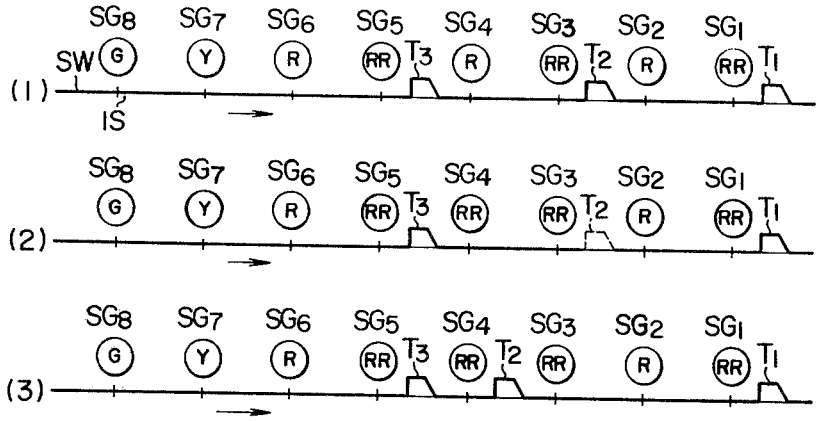
FIG. 7 illustrates the operation of the embodiment shown in FIGS. 5 and 6.

Another embodiment of the present invention is shown in FIGS. 3 to 7. FIGS. 3 and 4 show the basic idea of this embodiment, FIG. 5 is a block diagram of this embodiment, FIG. 6 shows partial details of the block diagram of FIG. 5, and FIG. 7 illustrates the operation of this embodiment.

The embodiment shown in FIGS. 3 to 7 is also applicable to cars of all the types regardless of the material of the rail-engaging wheels and ensures higher safety of car operation.

Railway cars are each necessarily provided with a plurality of rail-engaging wheels, and it is rarely the case that all the rail-engaging wheels are disengaged from the rails at the same time even in the event of a derailing accident. Therefore, the rails are reliably shorted with each other by the rail-engaging wheels, and, the track circuit system can operate with high reliability.

However, in the case of cars adapted for running along a track of concrete with rubber wheels as in a modern monorail system or in the case of cars used in a so-called new traffic system presently being developed in various countries, short-circuit cannot be attained in the manner in which the iron rails are shorted by the iron wheels of the railway cars. Thus, a car signaling system is proposed in which a pair of signal wires divided into a plurality of block sections by electrical insulating means are provided in lieu of the iron rails and are shorted by pantographs mounted on the cars, so that the interval between the cars can be maintained at a safe value according to the principle similar to that employed in the track circuit system shown in FIG. 1. For example, this idea is disclosed already in the embodiment of the present invention shown in FIG. 2.

However, these pantographs are provided to serve the exclusive purpose of signaling, and the primary function thereof differs from that of the rail-engaging wheels of iron which are provided necessarily in a plural number for guiding the running movement of the railway cars on the rails. It is therefore difficult and undesirable to provide a number of such pantographs on practical cars from the spatial and economical points of view. Further, in the case of the cars adapted for running with the rubber wheels, an undesirable situation such as puncture of the wheels is probable, and thus, the vertical and lateral displacements of the cars are generally greater than those of the cars running with the iron wheels. The pantographs mounted on the cars of this kind are required to make reliable sliding engagement with the signal wires even under such condition. A light weight is also required for these pantographs, but on the other hand, the structure thereof becomes inevitably complex.

Therefore, the possibility of disengagement of the pantographs from the signal wires resulting in incapability of short-circuit is high compared with the track circuit system in which the iron rails are shorted by the iron wheels. This possibility leads to an undesirable reduction of the reliability of the car signaling system utilizing the pantographs for shorting the signal wires. In the event of occurrence of such a failure, the car following the preceding car cannot detect the presence of the preceding car, and the danger of collision or any other accident may result. Further, in an extremely rare case, a very dangerous situation may occur in which the succeeding car cannot detect the preceding car which runs backward toward the succeeding car due to, for example, a car trouble.

The embodiment of the present invention shown in FIGS. 5 and 6 is provided to obviate such a danger. The basic idea of this embodiment will be described with reference to FIGS. 3 and 4.

Referring to FIG. 3, a pair of signal wires SW are provided in lieu of the rails LL shown in FIG. 1 and are divided into a plurality of block sections by electrical insulating means IS. In FIG. 3, a single signal wire SW is merely shown to avoid complexity, and electrical insulating means IS are shown by a single line for convenience. A plurality of cars $T_1$ to $T_3$ having rail-engaging wheels of rubber run in a direction as shown by the arrow, and a plurality of signal units $SG_1$ to $SG_8$ are provided. The symbols G, Y, R and RR designate respectively a proceed indication, a caution indication, a stop indication, and an absolute stop indication inhibiting absolutely the entrance of the car in the block section in which this indication is given. Although not shown in FIG. 3, a transmitter-receiver unit is provided for each block section, and the relation among received signals signal indications on the signal units controlled thereby and transmitted signals is selected to be as shown in FIG. 4.

Suppose now that the cars $T_1$, $T_2$ and $T_3$ run normally in the advancing direction in a relation in which they are spaced apart necessarily from each other by at least one block section as shown in FIG. 3-1. More precisely, each of these cars $T_1$ to $T_3$ would not proceed into the forward block section when the signal unit located in the advancing direction thereof gives the R-indication or when a signal $f_R$ is transmitted from the block section in which it is present. In the above state, the car is being decelerated or ready to be decelerated in the specific block section. It will be seen from FIGS. 3 and 4 that, when the car proceeds from one block section into the next adjacent block section with respect to the proceeding direction of the car, the signal received in the one block section or the indication of the signal unit in the one block section is shifted to the next upper level, while on the other hand, no signal is received by the next adjacent block section and the signal unit in the next adjacent block section gives the RR-indication.

Suppose then that the pantographs mounted on the car $T_2$ are disengaged from the signal wires SW, the indications of some of the signal units change in a manner as shown in FIG. 3-2. Note that the indication of the signal unit $SG_3$ in FIG. 3-2 changes from RR to Y. This change is a phenomenon which does not occur normally.

A situation as shown in FIG. 3-3 occurs when the car $T_2$ runs backward into the rearward block section. In this case too, the indication of the signal unit $SG_3$ changes from RR to Y. This change is also a phenomenon which does not occur normally. Such a change in the indication of the signal unit from one level to another level beyond more than one intermediate level, for example, from RR to Y, means than an unusual situation takes place.

According to the present embodiment based on the idea above described, the cars are advanced necessarily with the spacing corresponding to at least one block section therebetween, and at least four kinds of signal indications are employed, so that occurrence of an unusual situation can be easily detected when the indication of the signal unit changes from one level to another beyond more than one intermediate indication level.

Referring now to FIG. 5, the car signaling system includes a plurality of signal controllers $SC_1$ to $SC_6$, a plurality of transmitter-receiver units $TR_1$ to $TR_6$, a pair of pantographs P mounted on each car for sliding engagement with a pair of signal wires SW divided into a plurality of block sections by electrical insulating means IS, and a plurality of signal units $SG_1$ to $SG_6$ similar to those shown in FIG. 3.

FIG. 6 shows in detail the structure of one of the signal controllers SC associated with the corresponding transmitter-receiver unit TR. In FIG. 6, the signal controller SC includes filters $F_{RR}$ and $F_R$ allowing selective passage of the respective signals $f_{RR}$ and $f_R$ therethrough, another filter $F_Y$ allowing passage of the signal $f_Y$ or $f_G$ therethrough, slow-operating relays $SR_{y1}$ to $SRy_3$, relays $Ry_1$ and $Ry_2$, relay contacts $S_1$ to $S_{11}$ of these relays, and a power source E. The signal unit SG includes four signal lamps giving color signal indications of G, Y, R and RR respectively.

Suppose that one of the cars is running in the block section between the signal units $SG_1$ and $SG_2$, and the pantographs P are shorting the signal wires SW in this block section as shown in FIG. 5. In such a state, the transmitter-receiver unit $TR_2$ receives no signal and transmits the signal $f_{RR}$ as will be apparent from FIG. 4. Thus, no output appears from anyone of the filters $F_{RR}$, $F_R$ and $F_Y$ in the signal controller SC, and none of the relays $SRy_2$, $Ry_1$ and $Ry_2$ are energized. The slow-operating relay $SRy_3$ is not energized too, and the relay contact $S_{11}$ thereof is in the closed position. Therefore, the signal $f_{RR}$ generated by the transmitter-receiver unit $TR_2$ is transmitted to the rearward block section through the relay contact $S_{11}$. At this time, the slow-operating relay $SRy_1$ is also in the deenergized state and the relay contact $S_1$ thereof is in the closed position. Thus, the signal lamp RR is energized. The remaining signal lamps R, Y and G are not energized due to the fact that the relay contacts $S_3$, $S_4$ and $S_6$ are in the open position.

Suppose then that the car preceding the car presently considered is present in the forward block section spaced by more than two block sections from the block section between the signal units $SG_1$ and $SG_2$. In this case, the transmitter-receiver unit $TR_1$ receives one of the signals $f_{RR}$, $f_R$, $f_Y$ and $f_G$. Therefore, one of the signals $f_R$, $f_Y$ and $f_G$ is shorted by the pantographs P of the succeeding car running in the block section between the signal units $SG_1$ and $SG_2$.

If the pantographs P of the succeeding car were disengaged from the signal wires SW in the position shown in FIG. 5, the signal being received by the transmitter-receiver unit $TR_2$ changes abruptly to one of the signals $f_R$, $f_Y$ and $f_G$. When, for example, the signal $f_R$ is received by the transmitter-receiver unit $TR_2$ as a result of the above change, the relay $Ry_1$ is immediately energized, and the slow-operating relay $SRy_1$ is energized to open contacts $S_1$ and $S_2$ with a predetermined delay time. The slow-operating relay $SRy_3$ is then energized through the relay contacts $S_2$ and $S_5$. Due to the slow-operating characteristic, the relay $SRy_3$ would not respond to momentary disengagement of the pantographs P from the signal wires SW due to, for example, rolling movement of the running car, but it operates when disengagement of the pantographs P from the signal wires SW lasts over more than a predetermined period of time of, for example, 1 second due to a pantograph trouble. In response to the operation of the slow-operating relay $SRy_3$, the relay contact $S_8$ is closed to energize the signal lamp RR. At this time, the relay contact $S_9$ is opened to prevent the signal lamps G, Y, and R from being energized or remaining in the energized state. Further, the relay contact $S_{11}$ is opened to prevent transmission of the signal from the transmitter-receiver unit $TR_2$ to the next adjacent block section. FIG. 7 shows a diagram similar to that shown in FIG. 3. FIG. 7-1 shows the indications of the signal units when the cars are normally running. Then, if the pantographs P of the car $T_2$ were disengaged from the signal wires SW, the indications of the signal units would become as shown in FIG. 7-2.

In the above description, it is supposed that the signal received by the transmitter-receiver unit $TR_2$ changes abruptly from nil to $f_R$. The slow-operating relay $SRy_3$ is similarly energized through the relay contacts $S_2$ and $S_7$ when the signal changes from nil to $f_Y$ or $f_G$.

Suppose then that the car in FIG. 5 runs backward to move into the block section between the signal units $SG_2$ and $SG_3$. In such a case too, the signal received by the transmitter-receiver unit $TR_2$ changes abruptly from zero to one of $f_R$, $f_Y$ and $f_G$. This change is similar to that occurred when the pantographs P of the car are disengaged from the signal wires SW as described with reference to FIG. 7-2. The slow-operating relay $SRy_3$ is energized in FIG. 6, and no signal is transmitted to the block section into which the car $T_2$ moves backward as shown in FIG. 7-3. For the car $T_2$, this is equivalent to the case in which it proceeds into the block section in which no signal appears, that is, the block section in which the preceding car $T_1$ exists already. Thus, the emergency brakes are applied and the car $T_2$ can be immediately stopped. Further, due to the fact that no signal is transmitted to the block section into which the car $T_2$ moves backward, the signal unit $SG_4$ provides the RR-indication for the succeeding car $T_3$. Thus, the emergency brakes are applied and the car $T_3$ can be immediately stopped.

It will be seen from the above description of the second embodiment of the present invention that failure of shorting the signal wires due to disengagement of the pantographs from the signal wires can be reliably detected. Thus, a fatal accident such as collision of the cars can be reliably prevented. Further, even when one of the cars may run backward, signal indications are provided for instructing immediate emergency stoppage of the specific car and succeeding car so that a fatal accident such as collision of the cars can also be reliably avoided before such accident occurs.

Although the above description has referred to an application of the present invention to cars employing rail-engaging wheels of rubber, it is apparent that the present invention is applicable to cars of all the types which are provided with pantographs making sliding engagement with signal wires disposed to extend along a track.

Further, it is apparent that the signal units may be installed in the cars instead of on the ground. In such a case, the signal current flowing through the pantographs is detected on the car, and the result of signal current detection is indicated on the cab signal unit. Such an arrangement can be easily done.

Figure 8:
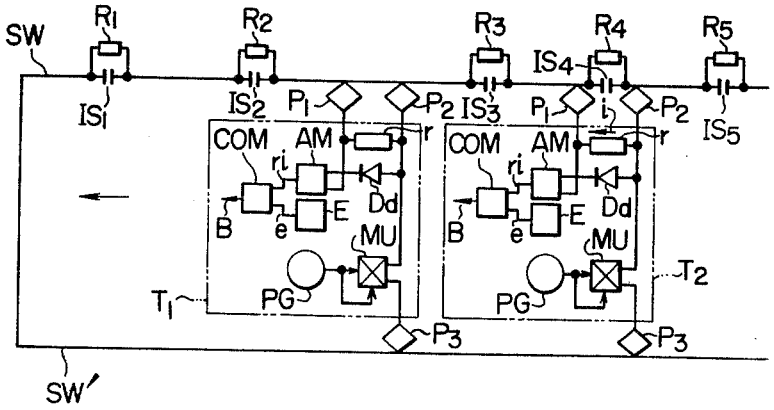
FIG. 8 is a circuit diagram of still another embodiment of the present invention.

FIG. 8 is a circuit diagram of still another embodiment of the present invention. The car signaling system shown in FIG. 8 is inexpensive and applicable to cars of all the types like the first and second embodiments described hereinbefore. In order that more cars can run on a track with the interval therebetween maintained at a safe minimum, it is necessary to divide the track circuit into as many block sections as are feasible. However, this requires provision of very complex and expensive signal equipments on the ground resulting in high equipment costs which are undesirable from the practical point of view. Such a drawback is obviated by the embodiment of the present invention shown in FIG. 8.

Referring to FIG. 8, cars $T_1$ and $T_2$ having rail-engaging wheels of rubber run along a track in a direction as shown by the arrow. A pair of signal wires SW and SW' are disposed to extend along the track, and the signal wire SW is divided into a plurality of block sections by electrical insulating means $IS_1$ to $IS_5$. Resistors $R_1$ to $R_5$ are connected in parallel with the respective electrical insulating means $IS_1$ to $IS_5$. Each of the cars $T_1$ and $T_2$ is provided with a front pantograph $P_1$ and a rear pantograph $P_2$ which are disposed in the advancing direction of the car and are spaced from each other by a distance greater than the length of the electrical insulating means IS. These pantographs P make sliding engagement with the signal wire SW. Another pantograph $P_3$ is provided on each of the cars $T_1$ and $T_2$ for making sliding engagement with the signal wire SW'. The signal wires SW and SW' are shorted to each other at the end of the track as shown.

The internal circuit of each of the cars $T_1$ and $T_2$ includes a resistor $r$ connected in parallel with the pantographs $P_1$ and $P_2$ and having a resistance value sufficiently lower than those of the resistors $R_1$ to $R_5$, a diode $Dd$, an analog memory AM, a constant-voltage source E, a comparator COM, a tachometer generator PG, and a multiplier MU for multiplying the output of the tachometer generator PG by itself.

In the system shown in FIG. 8, the voltage across the pantographs $P_2$ and $P_3$ of each car is equal to the output voltage of the multiplier MU and is thus proportional to the square of the speed of each car. Suppose, for example, that $v_1$ and $v_2$ are the speed of the respective cars $T_1$ and $T_2$. Then, the voltages across the pantographs $P_2$ and $P_3$ of the respective cars $T_1$ and $T_2$ are given by $kv_1$ and $kv_2{}^2$, when $k$ is a constant.

When the cars $T_1$ and $T_2$ are in the positions shown in FIG. 8, a closed circuit is formed which is traced from the multiplier MU in car $T_1$-pantograph $P_2$ of car $T_1$ resistor $R_3$-pantograph $P_1$ of car $T_2$-resistor $r$ in car $T_2$-multiplier MU in car $T_2$-pantograph $P_3$ of car $T_2$-signal wire SW' to the multiplier MU in car $T_1$. In this case, a route is also formed which includes the pantograph $P_1$ of car $T_2$, resistor $R_4$ and pantograph $P_2$ of car $T_2$ and is parallel with the resistor $r$ in the car $T_2$. However, this route is not taken into consideration herein since the resistance value of the resistor $r$ is sufficiently low compared with that of the resistor $R_4$.

The following relation holds in the closed circuit above described:

$$kv_2{}^2 - kv_1{}^2 = (R_3 + r)i \approx R_3 i \qquad (1)$$

where $i$ is the current flowing through the closed circuit. Therefore, the voltage drop across the resistor $r$ is given by $$ir = \frac{rk(v_2^2 - v_1^2)}{R_3} \quad (2)$$

It will be apparent from the equation (2) that $ri > 0$ when $v_2 > v_1$. This voltage drop $ri$ is applied through the diode D$d$ to the analog memory AM to be stored therein. The output of the analog memory AM and the output $e$ of the constant-voltage source E is compared with each other by the comparator COM. That is, the voltage drop $ri$ is compared with the voltage $e$ by the comparator COM.

Suppose now that the resistance values of the resistors $R_1$ to $R_5$ are selected to be proportional to the lengths of the individual block sections, then the series resistance value of the resistors $R_1$ and $R_5$ is approximately proportional to the distance between the cars $T_1$ and $T_2$ when the cars $T_1$ and $T_2$ are spaced apart by a distance including these resistors. In the case of FIG. 8, the resistor $R_3$ is solely present between the cars $T_1$ and $T_2$. Therefore, $R_3 \approx K'D$, where $K'$ is a constant and D is the distance between the cars $T_1$ and $T_2$.

Suppose that the comparator COM generates a braking instruction output B when the relation $ri \geqq e$ holds, and that the constant voltage $e$ is selected to satisfy the relation $e = 2rk\beta/k'$. Then when the condition $ri = e$ holds, the following equation is obtained:

$$\frac{rk(v_2^2 - v_1^2)}{k'D} = \frac{2rk\beta}{k'} \quad (3)$$

The distance D is given by $$D = \frac{v_2^2 - v_1^2}{2\beta} \quad (4)$$

where $\beta$ is the deceleration which can be produced when the emergency brakes are applied to the car. It is known that the relation $$D > \frac{v_2^2 - v_1^2}{2\beta}$$

expresses the condition for preventing the succeeding car $T_2$ from colliding against the preceding car $T_1$ even when the emergency brakes are applied to the car $T_1$ at whatever time. Therefore, the voltage $e$ is preferably selected to satisfy the relation $e < 2rk\beta/k'$ so that the emergency brakes can be applied to the car $T_2$ when the relation $$D > \frac{v_2^2 - v_1^2}{2\beta} \quad (5)$$

is satisfied, and the collision of the succeeding car $T_2$ against the preceding car $T_1$ can be reliably avoided.

In the case in which the pantographs $P_1$ and $P_2$ of the succeeding car $T_2$ do not bridge across one of the resistors $R_1$ to $R_5$ as in the case of the preceding car $T_1$ in FIG. 8, the resistor $r$ is shorted by the pantograph $P_1$, signal wire SW and pantograph $P_2$, and no imput is applied to the analog memory AM. However, due to the fact that the input previously applied thereto is stored in the analog memory AM, the braking instruction output B can be satisfactorily delivered from the comparator COM when brake application is required. In this manner, the voltage drop $ri$ corresponding to both the speed of the preceding car relative to that of the succeeding car and the distance between the succeeding car and the preceding car is detected each time the pantographs $P_1$ and $P_2$ of the succeeding car move past the electrical insulating means $IS_1$ to $IS_5$, so that the safe minimum car interval can be always maintained between the succeeding car and the preceding car on the basis of the running speed of the succeeding car relative to that of the preceding car.

In FIG. 8, there are no cars preceding the car $T_1$. It is to be noted that the voltage across the pantographs $P_2$ and $P_3$ of the car is zero when the car stands stationary. Thus, the shorted ends of the signal wires SW and SW' may be regarded as an imaginary preceding car for the car $T_1$ under consideration. It is therefore apparent that the control similar to that applied to the car $T_2$ and cars following the car $T_2$ can be applied to the car $T_1$.

The interval between the cars can be controlled in the manner above described. The car signaling system emboding the present invention can operate with remarkably improved reliability due to the fact that the ground equipment is composed of simple elements such as signal wires and resistors and is thus of quite simple construction and that elements tending to malfunction by being affected by electrical noises are not used therein. Further, the equipment costs can be reduced because of the simple construction of the ground equipment. Furthermore, the car signaling system is fail-safe even when noises are applied to the analog memory AM in addition to the voltage drop input $ri$, since the noises act to increase the output of the analog memory AM.

Figure 9:
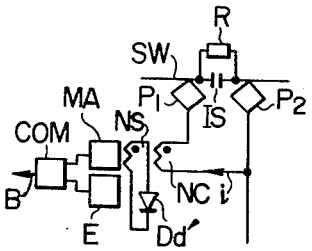
FIG. 9 is a circuit diagram of yet another embodiment of the present invention.

FIG. 9 is a partial modification of the car signaling system shown in FIG. 8. In FIG. 9, a magnetic amplifier is used to replace the resistor $r$, diode D$d$ and analog memory AM shown in FIG. 8.

Figure 10:
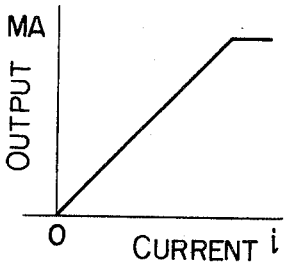
FIG. 10 shows the input-output characteristic of the circuit shown in FIG. 9.

Referring to FIG. 9, a magnetic amplifier MA having a control winding N$c$ (generally having a low resistance value) and a short-circuit winding $N_S$ is connected to the comparator COM, and a diode D$d'$ is disposed in the short-circuit winding $N_S$. This magnetic amplifier MA has an input-output characteristic as shown in FIG. 10. When current $i$ flows through the control winding $N_C$ in a direction as shown by the arrow, that is, in a direction in which the output of the magnetic amplifier MA is increased, a reverse voltage for the diode D$d'$ is induced in the short-circuit winding $N_S$. In this case, no current flows through the short-circuit winding $N_S$ and the magnetic amplifier MA does not respond. However, when the current $i$ flowing through the control winding $N_C$ is reduced to zero, a forward voltage for the diode D$d'$ is induced in the short-circuit winding $N_S$, and current flows through the short-circuit winding $N_S$ to prevent the output of the magnetic amplifier MA from being reduced. In other words, the time constant is greatly increased. Thus, when the pantographs $P_1$ and $P_2$ of the car are in a position in which they bridge across the electrical insulating means IS as shown in FIG. 9, the value of current $i$ is stored in the magnetic amplifier MA only when the current $i$ determined by the equation (1) flows through the control winding $N_C$ in the direction shown by the arrow. Therefore, a braking instruction output B similar to that described with reference to FIG. 8 can be obtained by applying the output of the magnetic amplifier MA to the comparator COM to be compared with the output *e* of the constant-voltage source E.

The modification shown in FIG. 9 is simple in construction and can yet operate with high reliability since a single magnetic amplifier can perform the function of the resistor *r*, diode D*d* and analog memory AM in FIG. 8.

The resistors $R_1$ to $R_5$ of the same resistance value may be provided when the signal wire SW can be divided into many block sections of equal length. When the length of each individual block section thus obtained is smaller than the spacing between the pantographs $P_1$ and $P_2$ of the car, the series resistance value of the resistors $R_1$ to $R_5$ shorted by the pantographs $P_1$ and $P_2$ is always substantially constant. In such a case, therefore, the resistors *r* in FIG. 8 can be eliminated. Further, the analog memories AM in FIG. 8 may be replaced by a simpler one, for example, a smoothing circuit due to the fact that the voltage drop across the resistors $R_1$ to $R_5$ shorted by the pantographs $P_1$ and $P_2$ of the car is always applied to the internal circuit of the car. In an extreme case, the analog memories AM may be eliminated to further simplify the construction of the equipment on the car.

Figure 11:
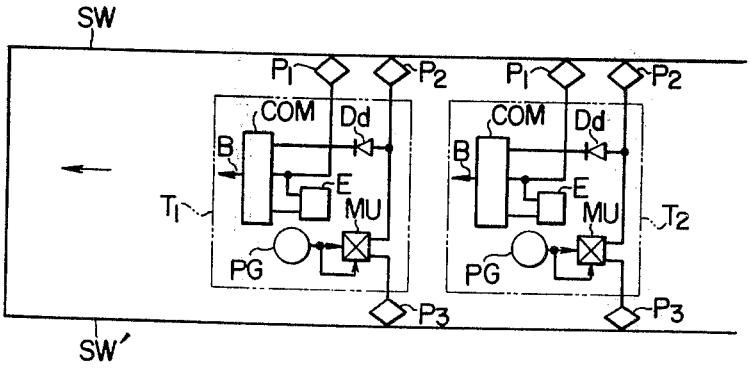
FIGS. 11 and 12 are circuit diagrams of other embodiments of the present invention.

FIG. 11 shows another modification representing an extremely simplified form of the car signaling system shown in FIG. 8. Referring to FIG. 11, a wire having a highest possible specific resistance value such as a nickrome wire is employed as the signal wire SW. Since the impedance of the signal wire SW in FIG. 11 is proportional to the length thereof, the electrical insulating means IS and impedance elements or resistors $R_1$ to $R_5$ interconnecting the adjacent block sections shown in FIG. 8 are unnecessary in FIG. 11. Further, the analog memories shown in FIGS. 8 and 9 are also unnecessary since a continuous signal can be applied to each car through the pantographs $P_1$ and $P_2$. It will thus be seen that the car signaling system shown in FIG. 11 has a simplest construction and yet can control the interval between the cars with high precision.

It will be understood from the above description that the aforementioned embodiments include a ground equipment of simple construction and are thus quite inexpensive. Further, due to the fact that the ground equipment of simple construction does not include elements tending to mal-function by being affected by electrical noises, the reliability of controlling the interval between the cars at the safe minimum can be remarkably improved.

Although the drive source for the cars is not especially referred to in the embodiments of the present invention described hereinbefore, this drive source may be a power supply line disposed to extend along the track, or such may be a combination of a battery and an electric motor, or a diesel engine.

Figure 12:
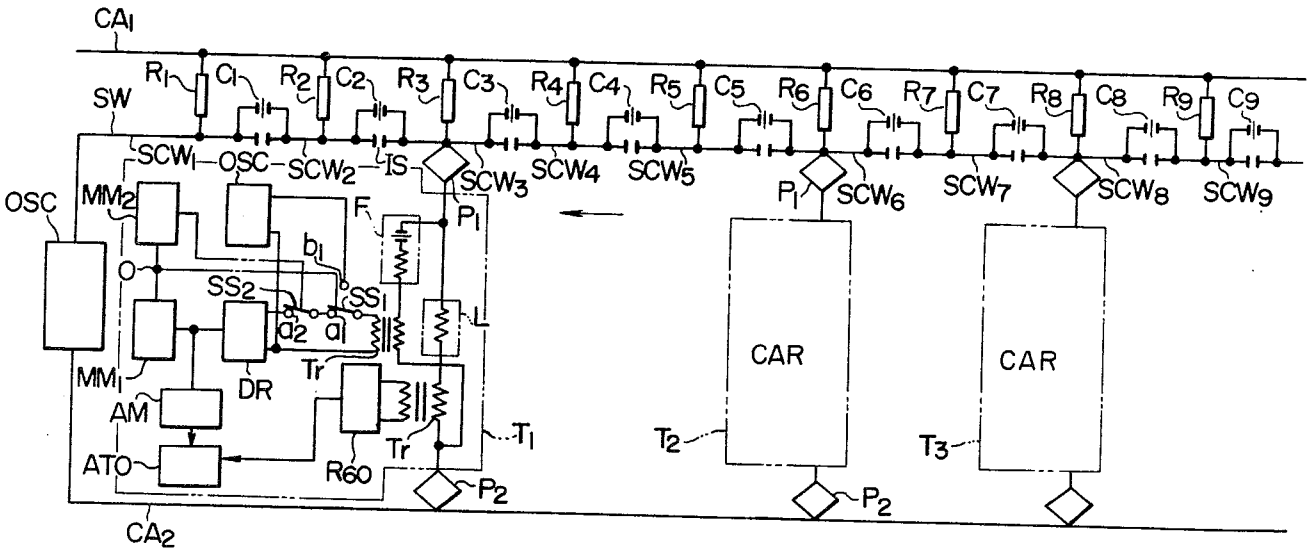

FIG. 12 is a circuit diagram of yet another embodiment of the car signaling system according to the present invention which is applicable to cars of all the types and is simple in construction and inexpensive.

Referring to FIG. 12, a plurality of cars $T_1$, $T_2$ and $T_3$ having rail-engaging wheels of rubber run along a track in a direction as shown by the arrow. A pair of 60-Hz power supply wires (trolley wires) $CA_1$ and $CA_2$ extend along the track for the cars $T_1$, $T_2$ and $T_3$. A signal wire SW extends along the track and is divided by electrical insulating means IS into a plurality of block sections $SCW_1$, $SCW_2$, . . . . . $SCW_9$. These block sections $SCW_1$ to $SCW_9$ are connected to the power supply wire $CA_1$ by respective resistors $R_1$ to $R_9$ which have resistance values selected to comply with allowable speed settings in the individual block sections. Capacitors $C_1$ to $C_9$ are connected to the signal wire SW in parallel with the respective electrical insulating means IS. Each of the cars $T_1$, $T_2$ and $T_3$ is provided with a pair of pantographs $P_1$ and $P_2$ which make sliding engagement with the signal wire SW and power supply wire $CA_2$ respectively.

A 5-KHz blocking oscillator $OSC_o$ is disposed at the terminal of the track in the advancing direction of the cars $T_1$, $T_2$ and $T_3$ to generate an output of duration *t* with a period of $t_o$. The internal circuit of each of the cars $T_1$, $T_2$ and $T_3$ includes a 5-KHz blocking reactor L, a filter F adapted for effecting series resonance with the frequency of 5 KHz, a 5-KHz oscillator OSC, an insulating transformer Tr, a 5-KHz receiver DR, one-shot multivibrators $MM_1$ and $MM_2$, switches $SS_1$ and $SS_2$, and an analog memory AM. The one-shot multivibrator $MM_1$ generates a pulse output of predetermined pulse width $t_1$ upon disappearance of the output of the receiver DR to actuate the switch $SS_1$. This switch $SS_1$ is connected at the contacts $a_1$ and $b_1$ respectively in the absence and presence of the output of the one-shot multivibrator $MM_1$. The other one-shot multivibrator $MM_2$ operates simultaneously with the one-shot multivibrator $MM_1$ to generate an output of pulse width $(t_0-t_1)$ to actuate the switch $SS_2$. This switch $SS_2$ is connected at the contacts $a_2$ and $b_2$ respectively in the absence and presence of the output of the one-shot multivibrator $MM_2$. The analog memory AM stores the peak value of the output of the receiver DR after being rectified. The internal circuit of each car further includes a 60-Hz receiver $R_{60}$ for receiving the allowable speed signal applied through one of the resistors $R_1$ to $R_9$ connected between the power supply wire $CA_1$ and the respective block sections $SCW_1$ to $SCW_9$ of the signal wire SW. The allowable speed signal is applied from the receiver $R_{60}$ to an automatic operating device ATO, and the signal representative of the distance between, for example, the car $T_1$ and the terminal or the cars $T_1$ and $T_2$ is applied from the analog memory AM to the automatic operating device ATO. The automatic operating device ATO corrects suitably the allowable speed signal depending on the distance signal for the purpose of controlling the operation of the car in which it is installed.

Figure 13:
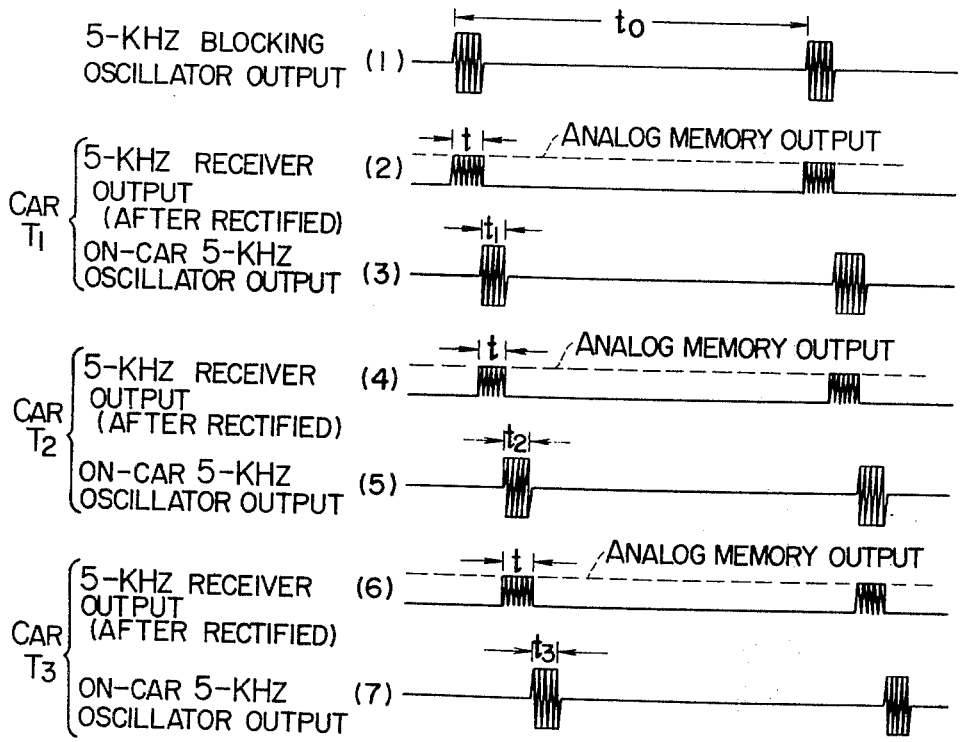
FIG. 13 illustrates the operation of the embodiment shown in FIG. 12.

A method of detecting the interval between one of the cars and the succeeding car will be described. The 5-kHz blocking oscillator $OSC_o$ disposed at the terminal (the left-hand end in FIG. 12) generates an output of predetermined duration *t* at a period $t_o$ as shown in FIG. 13-1. The output passes through the block sections $SCW_1$, $SCW_2$, $SCW_3$ and capacitors $C_1$, $C_2$ connected across these block sections to be applied to the switch $SS_1$ in the car $T_1$ through the pantograph $P_1$, 5-KHz pass filter F and insulating transformer Tr. This switch $SS_1$ is arranged to be actuated by the output of the one-shot multivibrator $MM_1$ and is connected at the contact $a_1$ when on output appears from the multivibrator $MM_1$ as described previously. Similarly, the switch $SS_2$ is arranged to be actuated by the output of the one-shot multivibrator $MM_2$ and is connected at the contact $a_2$ when on output appears from the multivibrator $MM_2$. When these switches $SS_1$ and $SS_2$ are connected in the positions above described, that is, when no outputs appear from both the multivibrators $MM_1$ and $MM_2$, the output of the blocking oscillator $OSC_o$ passes through the afore-mentioned route and switches $SS_1$, $SS_2$ to be applied to the 5-kHz receiver DR.

The output waveform of the receiver DR after being rectified is shown in FIG. 13-2. The peak value of the signal current received from the blocking oscillator OSCo is inversely proportional to the distance between the terminal and the car $T_1$. More precisely, the peak value of the signal current applied to the 5-kHz receiver DR from the blocking oscillator OSCo through the block sections $SCW_1$, $SCW_2$, $SCW_3$, capacitors $C_1$, $C_2$ and pantograph $P_1$ of car $T_1$ is proportional to the signal voltage and is inversely proportional to the impedance of the capacitors $C_1$ and $C_2$ connected across the block sections $SCW_1$, $SCW_2$ and $SCW_3$.

The above relations will now be formularized as numerical expressions. It is assumed herein that the impedance of the receiving circuit against the signal current of 5 kHz is very small, and the impedances of the resistors $R_1$ to $R_9$ against the signal current of 5 kHz are very large compared with those of the capacitors $C_1$ to $C_9$. Suppose now the $Av$, I, V, $f$ and C and the output voltage of the receiver DR, the peak value of the signal current, the signal voltage, the signal frequency, and the capacitance of the capacitors $C_1$ to $C_9$ connected in series, respectively. Then, the impedance of the capacitors $C_1$ to $C_9$ connected in series across the block sections $SCW_1$ to $SCW_9$ is given by $(1/2\pi fC)$. Suppose further that D is the distance between the blocking oscillator OSCo disposed at the terminal and the car $T_1$, and $k_1$, $k_2$, $k_3$ and $k_4$ are constants. Then, the following equations hold:

$$Av = k_1 I \tag{6}$$

$$I = k_4 \frac{V}{\frac{1}{2\pi fC}} = k_3 fCV \tag{7}$$

$$C = k_2/D \tag{8}$$

From the equations (1) and (2), the following equation is obtained:

$$(Av/k_1) = k_3 fCV \tag{9}$$

from the equations (8) and (9), the following equation is obtained:

$$aV = k_1(k_3 fV.k_2/D) \tag{10}$$

The analog memory AM in the car $T_1$ stores the peak value of the signal current given by the equation (10) and after being subjected to rectification. As soon as the output of the 5-kHz receiver DR disappears, the one-shot multivibrator $MM_1$ generates an output of predetermined pulse width $t_1$, and the switch $SS_1$ is changed over to be connected at the contact $b_1$ for a period of time corresponding to the duration $t_1$ of the pulse output of the multivibrator $MM_1$. Thus, the switch $SS_1$ is connected to the 5-kHz oscillator OCS in the car $T_1$. The one-shot multivibrator $MM_2$ operates simultaneously with the one-shot multivibrator $MM_1$ and generates an output of pulse width $(t_O - t_1)$. The switch $SS_2$ is changed over to be connected at the contact $b_2$ in response to the appearance of this output from the multivibrator $MM_2$ thereby disconnecting the 5-kHz receiver DR from the receiving circuit. Therefore, the output of the 5-kHz oscillator OSC in the car $T_1$ passes through the switch $SS_1$ to be transmitted to the succeeding car $T_2$ for a period of time corresponding to the duration $t_1$ of the pulse output of the one-shot multivibrator $MM_1$ as shown in FIG. 13-3, since the switch $SS_1$ is now changed over and connected at the contact $b_1$. More precisely, the output of the 5-kHz oscillator OSC in the car $T_1$ passes through the switch $SS_1$, insulating transformer Tr, 5-KHz pass filter F, pantograph $P_1$, block sections $SCW_3$, $SCW_4$, $SCW_5$, and capacitors $C_3$, $C_4$, $C_5$ to be transmitted to the pantograph $P_1$ of the succeeding car $T_2$, thence to the receiving circuit in the car $T_2$ in the manner in which the output of the 5-kHz blocking oscillator OSCo is applied to the receiving circuit in the car $T_1$. The output of the 5-kHz receiver DR in the car $T_2$ after being rectified is shown in FIG. 13-4.

Suppose that the number of the cars is $n$, then a total period of time of $(n + 1)t$ is required until all the cars can detect the intervals between them and their preceding cars. Therefore, the period $t_o$ must be selected to satisfy the relation $t_o > (n + 1)t$. In each of the cars $T_1$, $T_2$ and $T_3$, the interval detecting operation is repeated at time intervals of $t_o$, and the previously detected value is stored in the analog memory AM is each of the cars in the period in which the interval detection is not carried out by the car, while the value stored in the analog memory AM is renewed each time a new value is detected.

The output of the 5-kHz oscillator OSC in the car $T_1$ is transmitted to the succeeding car $T_2$ in a manner as described hereinbefore. This signal is received by the succeeding car $T_2$ in the same manner as when the preceding car $T_1$ receives the signal from the blocking oscillator OSCo. The interval between the succeeding car $T_2$ and the preceding car $T_1$ is thus detected, and immediately thereafter, the output of the 5-kHz oscillator OSC in the car $T_2$ is transmitted to the succeeding car $T_3$. The outputs of the receiver DR and oscillator OSC in the car $T_2$ are shown in FIGS. 13-4 and 13-5 respectively. The outputs of the receiver DR and oscillator OSC in the car $T_3$ are shown in FIGS. 13-6 and 13-7 respectively.

Each of the cars $T_1$ to $T_3$ runs continuously while successively detecting the interval between it and the preceding one in the manner above described. In such manner of interval detection, the oscillation output of the oscillator OSC in, for example, the car $T_2$ is transmitted not only to the succeeding car $T_3$ but also to the preceding car $T_1$. Thus, when the car $T_1$ receives the signal transmitted from the succeeding car $T_2$ before it receives the next signal transmitted from the blocking oscillator OSCo, the analog memory AM whose output should represent the distance between the car $T_1$ and the blocking oscillator OSCo may provide an incorrect output. However, such an undesirable situation cannot occur because the signal transmitted from the blocking oscillator OSCo is solely received at time intervals of $t_o$ by the action of the one-shot multivibrator $MM_2$ which prevents reception of any other unnecessary signals. In the case of the car $T_2$ following the car $T_1$ too, the signal transmitted from the oscillator OSC in the car $T_1$ is solely received at time intervals of $t_o$, and any other unnecessary signals are not received. This applies also to the car $T_3$.

Current is supplied from the 60-Hz power supply wire $CA_1$ to the block sections $SCW_1$ to $SCW_9$ through the resistors $R_1$ to $R_9$ having the resistance values selected to meet the allowable speed settings determined by the conditions of the track in these sections. Thus, the allowable speed signal is applied through the pantograph $P_1$, reactor L and insulating transformer Tr to the receiver $R_{60}$ in each car to be detected thereby. In this case, there is no possibility of interference between the signals of the two kinds transmitted to each car due to the fact that the reactor L has a very large impedance against the signal transmitted from the blocking oscillator OSCo or from the 5-kHz oscillator OSC in the preceding car and that the filter F has a very large impedance against the 60-Hz signal applied from the power supply wire $CA_1$.

The independency of these two kinds of signals can also be maintained in the circuit network consisting of the signal wire SW, power supply wire $CA_1$, resistors $R_1$ to $R_9$, and capacitors $C_1$ to $C_9$. As described above, the current is supplied from the power supply wire $CA_1$ to the block sections $SCW_1$ to $SCW_9$ through the respective resistors $R_1$ to $R_9$ so as to provide the allowable speed signal determined by the resistance value of each of these resistors $R_1$ to $R_9$, and this allowable speed signal is applied to each of the cars $T_1$ to $T_3$ when it enters the corresponding one of the block sections $SCW_1$ to $SCW_9$ of the signal wire SW. The frequency of this allowable speed signal is 60 Hz which is the same as that supplied from a source of commercial frequency to the power supply wire $CA_1$. The impedance of the capacitors $C_1$ to $C_9$ connected in series across the block sections $SCW_1$ to $SCW_9$ is given by $(1/2\pi fC)$ as described previously, where $f$ is the frequency of the signal applied from the power supply wire $CA_1$, and C is the series capacitance of the capacitors connected in series across the block sections. This impedance is very large against a low frequency such as the commercial frequency and acts as if the adjacent block sections were separated from each other. As a result, the allowable speed signal is determined by the resistance value of each of the resistors $R_1$ to $R_9$. On the other hand, the impedances of the capacitors $C_1$ to $C_9$ connected across the block sections $SCW_1$ to $SCW_9$ are small against the signal generated by the 5-kHz blocking oscillator OSCo or by the 5-kHz oscillator OSC in the preceding car, although such impedances are very large in the case of the speed signal as above described. Further, these impedances are quite low compared with those of the resistors $R_1$ to $R_9$. The signal current level is determined by the impedance of the capacitors $C_1$ to $C_9$. Thus, these two kinds of signals serving the different purposes and having the frequencies greatly different from each other can be transmitted by way of the block sections $SCW_1$, $SCW_2$, $SCW_3$, . . . . . of the signal wire SW to the cars $T_1$, $T_2$ and $T_3$ without interfering with each other and in an entirely independent relationship.

Another embodiment of the present invention for controlling a car by such two kinds of signals will be described with reference to FIG. 14. It is supposed for simplicity of description that another car preceding the car under consideration stands stationary. Suppose now that D, $v$ and $\beta$ are the distance between the preceding car and the succeeding car, the speed of the succeeding car, and the deceleration which can be produced by the succeeding car, respectively. Then, as is commonly known, the succeeding car would not collide against the preceding car when the following relation holds:

$$D > v^2/2\beta$$

However, the emergency brakes must be immediately applied to the succeeding car to prevent collision of the succeeding car against the preceding car when the following relation holds:

$$D = v^2/2\beta$$

Practical means which are adapted to make such operation will be described with reference to a block diagram of FIG. 4. An analog memory AM stores the peak value of a rectified signal current representative of the distance between the preceding car and the succeeding car. As will be apparent from the equation (10), this value is inversely proportional to the distance D. The output of the analog memory AM is applied to a divider DV in an automatic operating device ATO, and an output voltage proportional to the distance D appears from the divider DV. A tachometer generator PG in the automatic operating device ATO in the succeeding car detects the speed $v$ of the car and applies a speed responsive output to a multiplier MU. The multiplier MU delivers an output voltage proportional to $v^2/2\beta$ obtained by multiblying $v^2$ by a constant $1/2\beta$. The voltage proportional to $v^2/2\beta$ and the voltage proportional to the distance D between the preceding car and the succeeding car are applied to a comparator COM from the multiplier MU and divider DV respectively. The emergency brakes are not applied to the succeeding car by brake control means BR for controlling the speed of the car by decelerating the car when the divider output voltage proportional to the distance D between the preceding and succeeding cars is higher than the multiplier output voltage proportional to $v^2/2\beta$. However, the emergency brakes are applied by the brake control means BR when the latter voltage becomes equal to the former voltage, because there is the possibility of collision of the succeeding car against the preceding car. When there is no necessity for actuating the brake control means for applying the emergency brakes, output signals of the tachometer generator PG and receiver $R_{60}$ provided in the car are applied to a speed control unit TCR in the automatic operating device ATO to control powering control means PW for controlling the speed of the car by accelerating the car or the brake control means BR, so that the car can be automatically operated with the speed thereof controlled to be equal to a predetermined allowable speed selected to suit the track conditions including, for example, the gradient of the track and straightness of curvature of the track.

Figure 14:
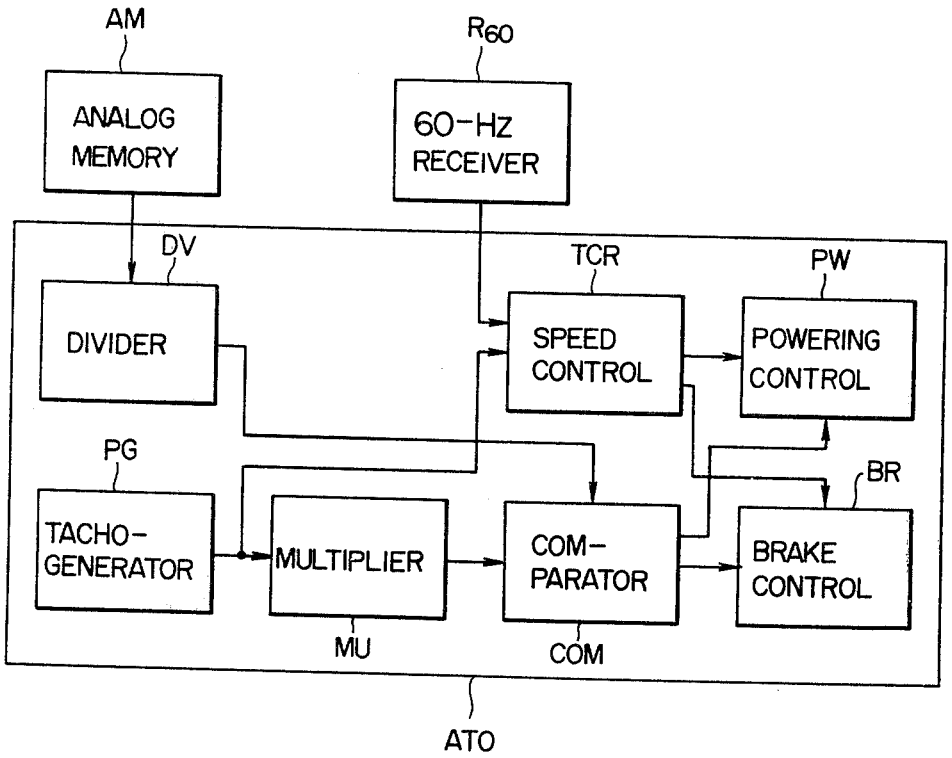
FIGS. 14 to 17 are circuit diagrams of other embodiments of the present invention.

The embodiments of the present invention shown in FIG. 12 and 14 provide various advantages as enumerated below.

1. It is utterly unnecessary to provide a group of complex and expensive amplifiers in each block section of the signal wire. In the car signaling system according to the present invention, highly reliable and inexpensive passive elements of simple structure such as capacitors are merely required in place of the expensive amplifier groups used in prior art systems. Thus, maintenance can be remarkably easily attained compared with the prior art arrangement.
2. Therefore, the length of the block sections can be shortened and the number of the block sections can be increased so that the precision of distance or interval detection can be easily improved.

3. Further, in track portions where high precision is not required especially, the length of the block sections can be increased to simplify the structure of the ground equipment correspondingly. This is easily attained since it is merely necessary to change the capacity of the capacitors.
4. The allowable speed signal which differs depending on the track conditions and the distance signal which represents the distance or interval between the cars can be transmitted to the cars by the same equipment.
5. An anti-collision control can be easily attained by detecting the distance or interval between the succeeding car and the preceding car.
6. The car signaling system according to the present invention is applicable to cars of all the types owing to the simple arrangement in which a signal wire is disposed to extend along the track and a pantograph is provided on each car to make sliding engagement with this signal wire.

Figure 15:
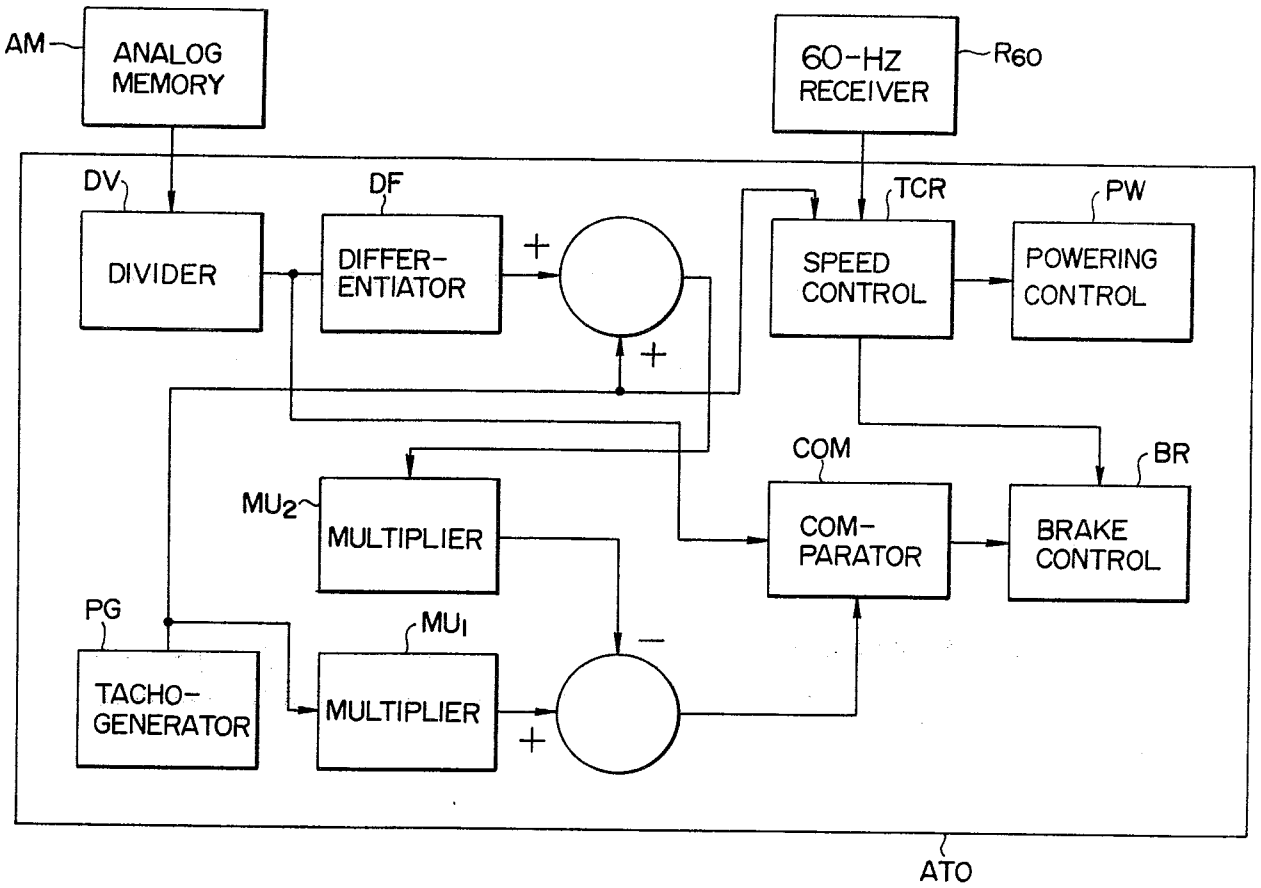

In the embodiment described with reference to FIG. 14, it is assumed that the preceding car stands stationary. However, such probability is low, and resorting to such a method will possibly result in the defect that the interval between the cars will become unnecessarily large. FIG. 15 shows a modification which overcomes such a defect.

Referring to FIG. 15, the analog memory AM stores the peak value of the rectified signal current representative of the distance D between the preceding car and the succeeding car, and this value is inversely proportional to the distance D as apparent from the equation (10). The output of the analog memory AM is applied to the divider DV, and an output voltage proportional to the distance D between the preceding and succeeding cars appears from the divider DV. The distance D between the preceding and succeeding cars is basically expressed as follows:

$$D = \int v_1 dt \int v_2 dt \qquad (11)$$

where $v_1$ and $v_2$ are the speeds of the preceding and succeeding cars respectively. Differentiation of the equation (11) gives $$dD/dt = v_1 - v_2 \qquad (12)$$

A differentiator DF is provided to provide an output representative of the result given by the equation (12). An output signal proportional to the speed of the preceding car is obtained when the output of the differentiator DF is added by an adder to the output of the tachometer generator PG.

The signal representative of the speed $v_1$ of the preceding car is applied from the adder to a second multiplier $MU_2$. The second multiplier $MU_2$ delivers an output voltage proportional to $v_1{}^2/2\beta$ obtained by multiplying $v_1{}^2$ by a constant $1/2\beta$. The output of the tachometer generator PG representative of speed $v_2$ of the succeeding car is applied to the first multiplier $MU_1$. This first multiplier $MU_1$ similarly delivers an output voltage proportional to $v_2^2/2\beta$ obtained by multiplying $v_2{}^2$ by the constant $1/2\beta$. Then, when the output of the second multiplier $MU_2$ is subtracted from the output of the first multiplier $MU_1$ by a subtractor, the subtractor delivers an output voltage proportional to the minimum safe interval $(v_2{}^2 31\ v_1{}^2)/2\beta$ required for avoiding collision of the succeeding car against the preceding car. This output is applied to the comparator COM as one input thereto. The divider output proportional to the distance D between the preceding and succeeding cars is applied to the comparator COM as the other input thereto. In order that the succeeding car can run while maintaining the minimum safe interval between it and the preceding car, it is necessary to satisfy the following relation:

$$D > (v_2{}^2 - v_1{}^2)/2\beta \qquad (13)$$

Thus, the automatic control may be such that the succeeding car runs at the predetermined allowable speed varying depending on the track conditions until and immediately before the right-hand and left-hand members of the equation (13) become equal to each other, and the emergency brakes are immediately applied to the succeeding car when the equality is detected.

According to the embodiment shown in FIG. 15, the automatic control taking into consideration both the distance or interval between the preceding and succeeding cars and the speed of the preceding car is carried out so as to prevent the car interval from becoming unnecessarily large.

In the embodiment shown in FIG. 12, the allowable speed signal varying depending on the track conditions is applied from the power supply wire $CA_1$ to the individual block sections $SCW_1$ to $SCW_9$ through the resistors $R_1$ to $R_9$, while the signal from the blocking oscillator OSCo or from the oscillator OSC in the preceding car is transmitted to the individual block sections $SCW_1$ to $SCW_9$ through the capacitors $C_1$ to $C_9$. However, when the line frequency of the power supply wire $CA_1$ is high, the capacitors $C_1$ to $C_9$ may be connected to the power supply wire $CA_1$, and the allowable speed signal varying depending on the track conditions may be applied from the power supply wire $CA_1$ to the individual block sections $SCW_1$ to $SCW_9$ through the capacitors $C_1$ to $C_9$. In such a case, the frequency of the signal generated by the blocking oscillator OSCo or by the oscillator OSC in the preceding car may be selected to be lower than the line frequency of the power supply wire $CA_1$, and the resistors $R_1$ to $R_9$ may be connected across the individual block sections $SCW_1$ to $SCW_9$ so that the signal may be applied through these resistors. Further, it is obvious that the same effect as that above described can be obtained even when inductance elements are used in lieu of the resistors $R_1$ to $R_9$.

Figure 16:
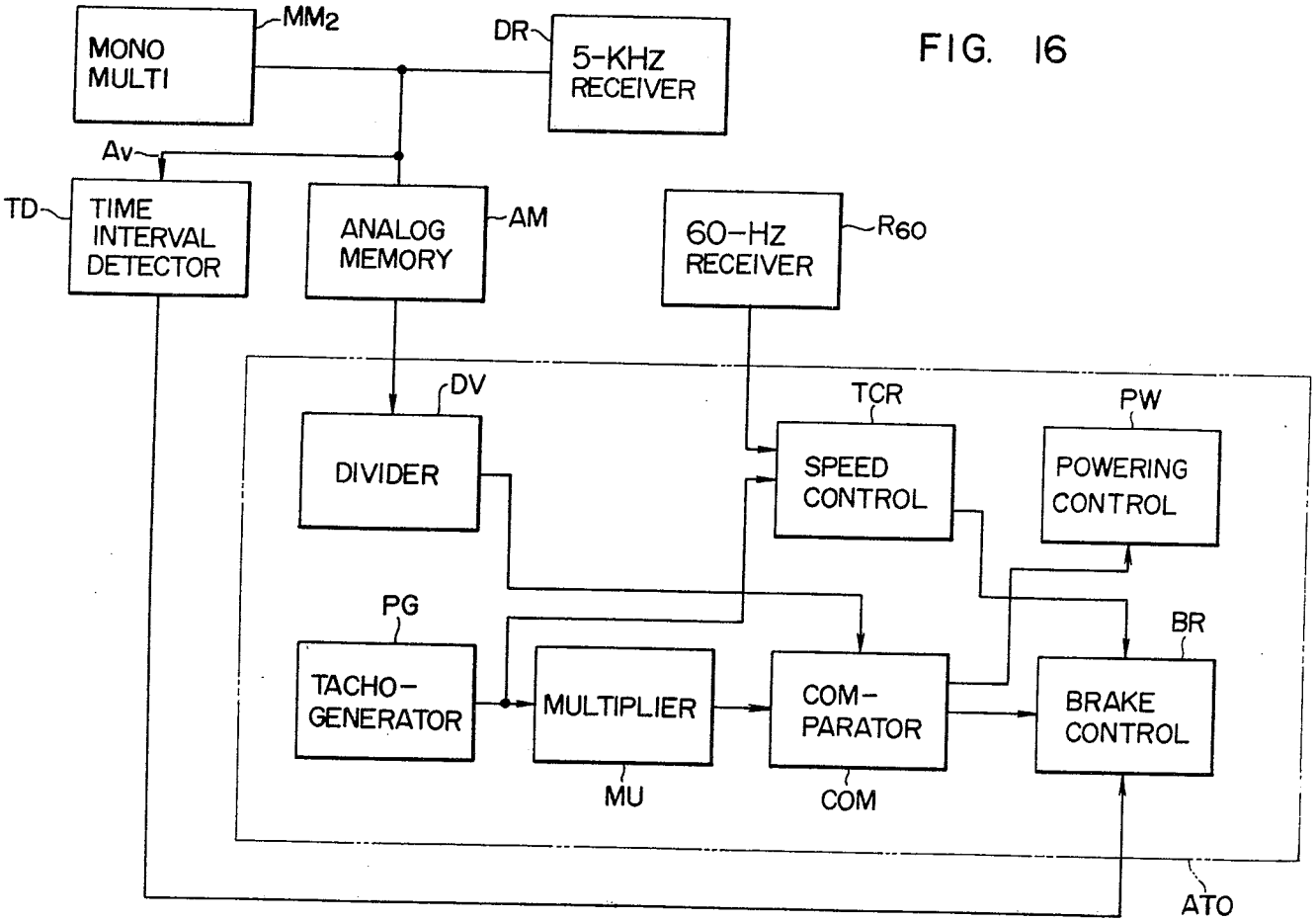

FIG. 16 shows a modification of the embodiments of the present invention shown in FIGS. 14 and 15. Referring to FIG. 16, a time interval detector TD is provided in each of the cars $T_1$, $T_2$ and $T_3$. The time interval detector TD detects the time interval of the signal transmitted from the blocking oscillator OSCo or from the oscillator OSC in the preceding car. The time interval detector TD does not in any way affect the operation of the automatic operating device ATO when the detected time interval is $t_0$. However, when the detected time interval differs from $t_o$, the time interval detector TD applies an instruction signal to the brake control means BR in the automatic operating device ATO so that the emergency brakes can be immediately applied to the specific car. Thus, when, for example, the pantograph $P_1$ of the preceding car is disengaged from the signal wire SW during running, the period of the output voltage A$v$ of the 5-kHz receiver DR is reduced by $t$ from the normal value of $t_0$, and the emergency brakes are applied to the succeeding car to prevent an accident such as collision of the succeeding car against the preceding car. The emergency brakes are similarly successively applied to the cars following this car.

Further, in the preceding car whose pantograph $P_1$ is disengaged from the signal wire SW, the output voltage $Av$ of the 5-kHz receiver DR is reduced to zero, and the time interval detector TD in this preceding car detects that the period of the receiver output voltage $Av$ becomes longer than the normal value of $t_o$. As a result, the emergency brakes are also applied to the preceding car itself whose pantograph $P_1$ is disengaged from the signal wire SW. Such operation is carried out not only when the pantograph $P_1$ is disengaged from the signal wire SW but also when failure occurs in the signal wire SW, capacitors $C_1$ to $C_9$, and switches $SS_1$ and $SS_2$. Thus, the provision of the time interval detector TD is advantageous in improving the reliability and safety of the car signaling system.

In the embodiment shown in FIG. 12, the output signal of the oscillator OSC in one of the cars is transmitted to the succeeding car, and at the same time, to the preceding car. This fact can be utilized so that the states of the cars preceding and following one of the cars can be always detected in that car.

Figure 17:
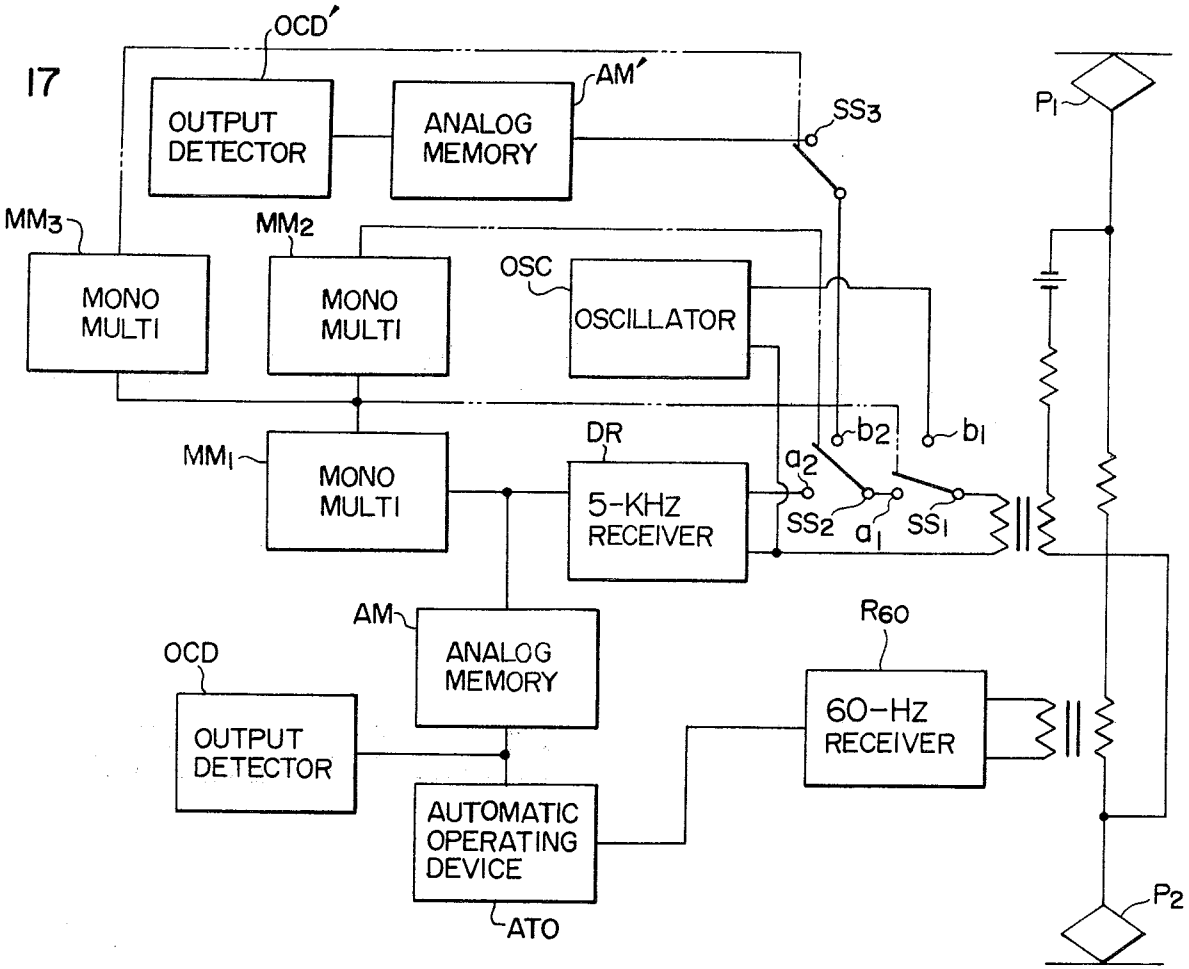

A modification of FIG. 12 adapted for this manner of car status detection is shown in FIG. 17. Referring to FIG. 17, a third one-shot multivibrator $MM_3$ generates a pulse output of predetermined pulse width $t_1$ upon disappearance of the output from the first one-shot multivibrator $MM_1$. A third switch $SS_3$ is turned on in response to the appearance of the output from the one-shot multivibrator $MM_3$. A second analog memory AM′ is provided in addition to the first analog memory AM, and a pair of detectors OCD and OCD′ are provided to detect an unusual change in the outputs of the respective analog memories AM and AM′.

As described with reference to FIG. 12, the second one-shot multivibrator $MM_2$ generates an output of predetermined pulse width $(t_o - t_1)$ upon disappearance of the output from the receiver DR, and the switch $SS_2$ is connected at the contact $b_2$ during the above period of time. Thus, when the switch $SS_3$ is turned on for the period of time $t_1$ upon disappearance of the output from the multivibrator $MM_1$, the signal transmitted from the oscillator OSC in the succeeding car is applied to the analog memory AM′ through the contact $a_1$ of the switch $SS_1$ and the contact $b_2$ of the switch $SS_2$.

It will thus be seen that the information of the distance or interval between the specific car and the preceding car and the information of the distance or interval between the specific car and the succeeding car are periodically applied to the respective analog memories AM and AM′ to renew the contents thereof. Any abrupt change does not occur normally in these values when the period is sufficiently shorter than the length of time required for the car to run through one block section.

However, if the pantograph of the car succeeding or preceding the specific car were disengaged from the signal wire SW resulting in impossibility of signal transmission and reception between these cars, the distance information stored in the analog memory AM or AM′ is the signal transmitted from the second succeeding car or from the second preceding car, and this value is generally about one-half the value of the signal transmitted from the first succeeding car or first preceding car. The detector OCD or OCD′ detects such a change. Thus, an unusual state occurring in the succeeding car or preceding car can be detected, and a proper measure can be taken to prevent occurrence of a fatal accident such as collision. For example, the car operator may report the unusual state occurring in the succeeding or preceding car to the central control station. The safety of the system can thus be improved.

It will be understood from the foregoing detailed description that the present invention provides a novel car signaling system in which a signal wire is disposed to extend along a track for cars, a pantograph is mounted on each of the cars to make sliding engagement with the signal wire, and means are provided to detect the relative interval between the cars on the basis of signals transmitted through the pantograph. The car signaling system according to the present invention is applicable to cars of all the types regardless of the material of rail-engaging wheels.

We claim:

1. A signaling system for cars having wheels adapted for running along a track, said signaling system comprising:

at least two signal wires disposed to extend along said track;

main pantograph means mounted on each of said cars for making sliding engagement with one of said signal wires;

subsidiary pantograph means mounted on each of said cars for making sliding engagement with the remainder of said signal wires, said main and subsidiary pantograph means being connected electrically; and first means for detecting the relative interval between said cars in response to the sliding movement of said main and subsidiary pantograph means along said signal wires.

2. A car signaling system as claimed in claim 1, wherein third means is provided in each of said cars to detect the fact that the current flowing through said pantograph means is reduced to zero and remains in the zero level over more than a predetermined length of time.

3. A car signaling system as claimed in claim 1, wherein at least one of said signal wires is divided into a plurality of block sections, adjacent ones of said block sections being connected with each other by an impedance element, and said first means is mounted in each of said cars to detect the relative interval between said cars by measuring the impedance of the signal wire portion between said cars.

4. A car signaling system as claimed in claim 3, wherein said main pantograph means mounted on each said car comprises a first pantograph for receiving a signal transmitted from the car preceding anyone of said cars, and a second pantograph for transmitting a signal from anyone of said cars to the car succeeding the same, and said first means detects the relative interval between said cars on the basis of a signal representative of the square of the speed of the preceding car transmitted from said second pantograph by way of said signal wire and another signal representative of the square of the speed of its own.

5. A car signaling system as claimed in claim 3, wherein said first means in each said car comprises a first oscillator for transmitting a signal to anyone of said cars, and a first receiver for receiving another signal transmitted from anyone of said cars, all said first oscillators in said cars generating output signals having the same amplitude and frequency, and said first means measures the impedance of the signal wire portion between these cars by detecting a change in the amplitude of the signal received by said first receiver.

6. A car signaling system as claimed in claim 5, wherein a second oscillator generating an output signal having the same amplitude and frequency as those of the signal generated by said first oscillator is provided at the terminal of said signal wire, and said first receiver in the car nearest to said signal wire terminal receives the output signal of said second oscillator.

7. A car signaling system as claimed in claim 6, wherein said second oscillator is a blocking oscillator generating periodically an output signal at a predetermined period.

8. A car signaling system as claimed in claim 7, wherein fourth means is provided in each of said cars to detect occurrence of an unusual situation when the period of the signal generated by said blocking oscillator and received by said first receiver deviates from the predetermined period.

9. A car signaling system as claimed in claim 5, wherein, after the signal transmitted from anyone of said cars is received by said first receiver in one of said cars, the output of said first oscillator in said specific car is transmitted to the other cars by way of said signal wire.

10. A car signaling system as claimed in claim 5, wherein said first means in each said car comprises a second receiver for receiving the signal transmitted to anyone of said cars from the succeeding car, and said first receiver in said specific car receives the signal transmitted from the preceding car.

11. A car signaling system as claimed in claim 10, wherein, after said first receiver in said specific car receives the signal transmitted from the preceding car, the output signal of said first oscillator in said specific car is transmitted to the other cars by way of said signal wire, and when said second receiver in said specific car receives the signal transmitted from the succeeding car.

12. A car signaling system as claimed in claim 5, wherein fifth means is provided in each of said cars to detect occurrence of an unusual situation when a rapid change occurs in the amplitude of the signal received by said first receiver.

13. A car signaling system as claimed in claim 3, wherein a power supply wire for supplying drive power to said cars is disposed to extend along said track, and a plurality of impedance elements having impedance values corresponding to the different track conditions are connected across said power supply wire and said signal wire.

14. A car signaling system as claimed in claim 13, wherein the signal corresponding to the specific track condition applied from said power supply wire to anyone of said cars through the associated one of said impedance elements is suitably corrected depending on the signal representative of the relative interval between that car and the adjacent one.

15. A car signaling system as claimed in claim 3, wherein sixth means is provided in each of said cars to produce a signal representative of the speed of the car adjacent to anyone of said cars on the basis of a signal representative of the relative interval therebetween detected as a result of the measurement of the impedance of the signal wire portion between said cars and another signal representative of the speed of its own, and said first means detects the relative interval between said cars taking into account also the difference between the speeds of said cars.

16. A car signaling system as claimed in claim 1, wherein at least one of said signal wires is divided into a plurality of block sections and second means is provided between adjacent ones of said block sections for transmitting a predetermined signal from each of said block sections to the succeeding block section depending on a signal transmitted thereto from the preceding block section, said first means being mounted in each of said cars to detect the relative interval between said cars upon reception of the output of said second means.

17. A car signaling system as claimed in claim 16, wherein said second means transmits and receives at least four signals indicating proceed, caution, stop and absolute stop for controlling the advancing movement of said cars, and each said car receiving the signals transmitted from said second means is inhibited from entering the block section in which said absolute stop signal is indicated.

18. A car signaling system as claimed in claim 17, wherein seventh means is provided for detecting occurrence of an unusual situation when the signal indication changes abruptly from one level to another beyond more than one intermediate indication level.

* * * * *